United States Patent [19]

Botte et al.

[11] 4,285,591

[45] Aug. 25, 1981

[54] COMPUTER-CONTROLLED COPY PRODUCTION MACHINE HAVING JOB SEPARATION CAPABILITIES

[75] Inventors: Anthony J. Botte; James H. Hubbard, both of Boulder, Colo.; Paul R. Spivey, Winchester, Ky.

[73] Assignee: International Business Machines Corporation, Armonk, N.Y.

[21] Appl. No.: 99,383

[22] Filed: Dec. 3, 1979

Related U.S. Application Data

[62] Division of Ser. No. 841,623, Oct. 13, 1977, Pat. No. 4,201,464.

[51] Int. Cl.[3] ..... G03G 15/00

[52] U.S. Cl. ..... 355/14 C; 271/290; 355/14 CU; 355/23

[58] Field of Search ..... 355/14 C, 3 R, 14 R, 355/14 CU, 23, 24, 26; 271/9, 290; 270/58

[56] References Cited

U.S. PATENT DOCUMENTS

| | | | |
|---|---|---|---|
| Re. 27,976 | 4/1974 | Sahley | 355/64 |
| 3,273,882 | 9/1966 | Pearson | 270/58 |
| 3,830,590 | 8/1974 | Harris et al. | 355/14 R |
| 3,870,295 | 3/1975 | Kukucka | 271/290 |
| 3,871,640 | 3/1975 | Ritzerfeld | 271/9 |
| 3,871,643 | 3/1975 | Kukucka et al. | 271/290 |

*Primary Examiner*—Richard L. Moses
*Attorney, Agent, or Firm*—Carl M. Wright

[57] ABSTRACT

Copy production machine under program control selectively interleaving copy separation sheets between successive copy jobs. The copy separation sheets can be supplied from the same copy sheet supply source as the copies being produced or from an alternate supply source. The number of separation sheets supplied is a predetermined relationship between the number of copy receiving bins in an output receiving the copy separation sheets and the number of copies to be produced from a source. The effective capacity of a collator is extended by such interleaving using a programmable control that talies copies made versus copies selected greater than the capacity of a collator such that the collator job is automatically segmented.

4 Claims, 21 Drawing Figures

FIG. 11
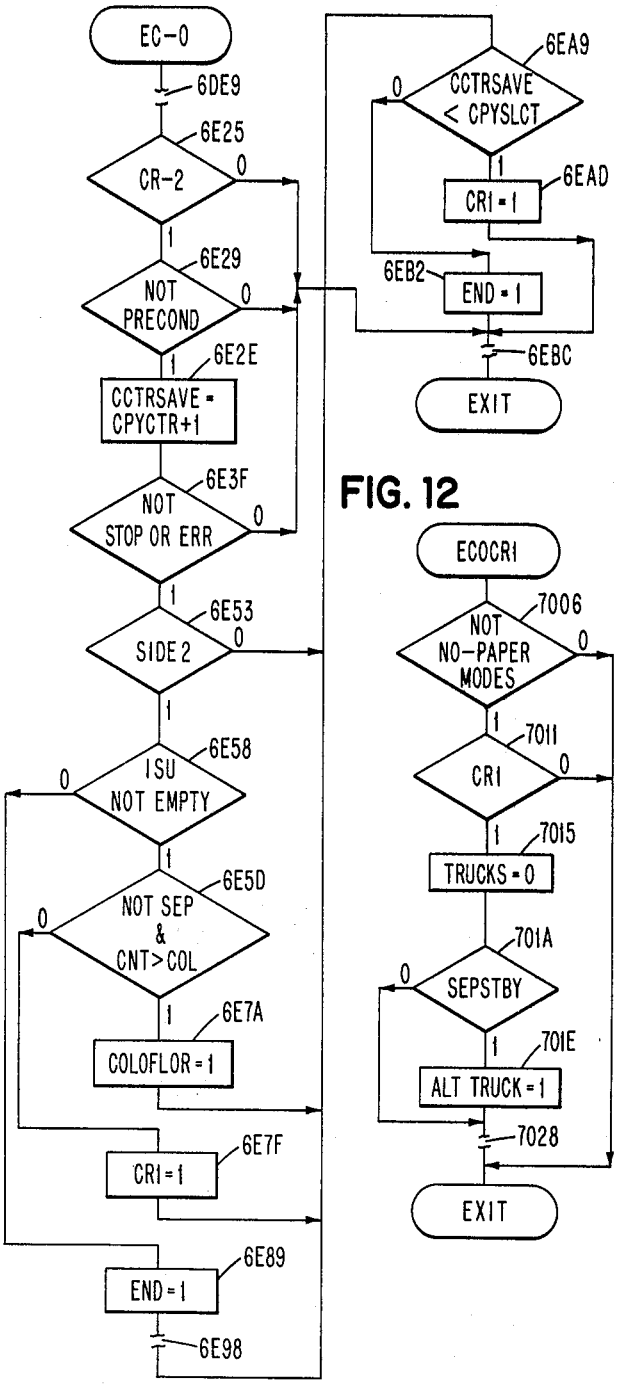
FIG. 12
FIG. 14
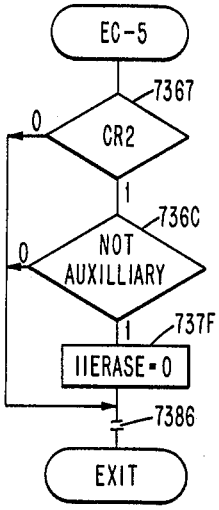
FIG. 15
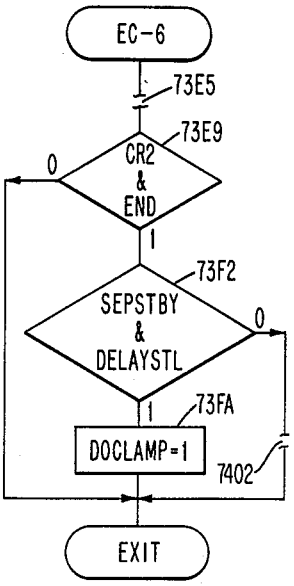

COMPUTER-CONTROLLED COPY PRODUCTION MACHINE HAVING JOB SEPARATION CAPABILITIES

This application is a divisional application of U.S. patent application Ser. No. 841,623 filed Oct. 13, 1977, now U.S. Pat. No. 4,201,464.

DOCUMENTS INCORPORATED BY REFERENCE

U.S. Pat. No. 4,114,871 by Botte, assigned to the same assignee as the present application.

U.S. Pat. No. 4,086,658 by Finlay, assigned to the same assignee as the present application.

Commonly assigned, copending application Ser. No. 841,623 filed Oct. 13, 1977 now U.S. Pat. No. 4,201,464.

BACKGROUND OF THE INVENTION

The present invention relates to copy production machines, particularly the convenience copier type, having the capability of producing a succession of copy jobs, which may be unrelated, in a succession of copy runs and of controlling a succession of such copy runs as a single copy job.

In some convenience copier types of copy production machines, only one run having a maximum number of copies can be produced automatically from an original document. Upon actuation of a start button or suitable document sensing apparatus, the copy production machine produces a given number of copies in accordance with the operator-inserted number in a control panel of the copier. Upon completion of the copies automatically produced, the copy production machine stops. In some instances, a semiautomatic document feed (SADF) enables an operator to provide a succession of original documents in a semiautomatic mode in which the copy production machine senses the presence of an additional original document and automatically starts a second run. A succession of related original documents can be conveniently termed as a copy job. For example, an operator wants to produce a given number of copies of several original documents comprising a report. Each copy job may therefore be characterized by one or more copy runs.

Some copy production machines have an automatic document feed, i.e., the machine will automatically manipulate original documents to provide collated copy sets without collating the produced copies. That is, a first copy of each original is made and then a second copy of each original is made, and so on. In this situation, a copy job includes a plurality of successive copy runs, each producing a set of copies. As used herein, the term set of copies is referred to as a subjob to be separated by a separation sheet. When an automatic document feed is used, a subjob is considered as a complete job for the copy production machine. Copy production machines usually have more than one copy paper source. One source is usually referred to as the main supply and the other, as the auxiliary supply. Generally, the main supply stores more copy sheets than the auxiliary supply. The operator can select which source the copy sheets are to be supplied from. In some machines, a roll of paper is the source of copy sheets. A plurality of rolls may be provided or combination of rolls and precut sheets of copy paper may be utilized as a plurality of sources of copy paper.

Collating apparatus, which is usually quite expensive, are often attached to copiers. To control cost, the smallest size of collator is usually used. With a small collator, the copy producing capability of the copy production machine may be limited by the collator capacity. In a small office where the number of collated copies is a minor requirement, no collator is attached.

If a copy job exceeds the capacity of the collator, it must be done in parts. If there is no collator, the collation must be done manually.

This invention is directed to an enhanced separation capability in a copy machine operated under program control.

SUMMARY OF THE INVENTION

A copy production machine comprises a combination of operating units which include image input, copy production, copy output means having a given capacity, and a copy sheet transport path which couples the copy production part with the output means. There is also a copy sheet source supplying the copy sheets to the copy production part to receive images. An improvement comprising a programmable processor for executing computer programs and having input registers for receiving signals and output registers for supplying signals to the processor also has a means included in the operating means coupled to the input register for supplying status signals to the processor. There are also actuating means in the operating means coupled to the output registers to receive control signals in order to control the operation of the machine. A console means is supplied which includes a plurality of switches coupled to the input registers for providing operating parameters to control the processor means in operating the machine and also includes a plurality of indicators coupled to the output registers for displaying the status of the machine. A memory includes programs executable by the processor to produce a number of copies as selected from the console means and the program includes means for responding to one of the switches indicating, when actuated, that the copy sheets are to be supplied from the copy sheet source and inhibiting means for preventing the copying of images onto such selected copy sheets whereby the copy sheets so supplied become separator sheets. The program also provides means for limiting the production run to the given output capacity if the operating parameter representing a number of copies to be produced exceeds the given capacity and has means for indicating cumulative copies produced in a series of production runs in response to the actuation of the switch.

BRIEF DESCRIPTION OF THE DRAWINGS

FIG. 11 is a flowchart of the EC0 process.
FIG. 12 is a flowchart of the EC0-CR1 process.
FIG. 14 is a flowchart of the EC5 process.
FIG. 15 is a flowchart of the EC6 process.

DETAILED DESCRIPTION OF THE INVENTION

Figure 1:
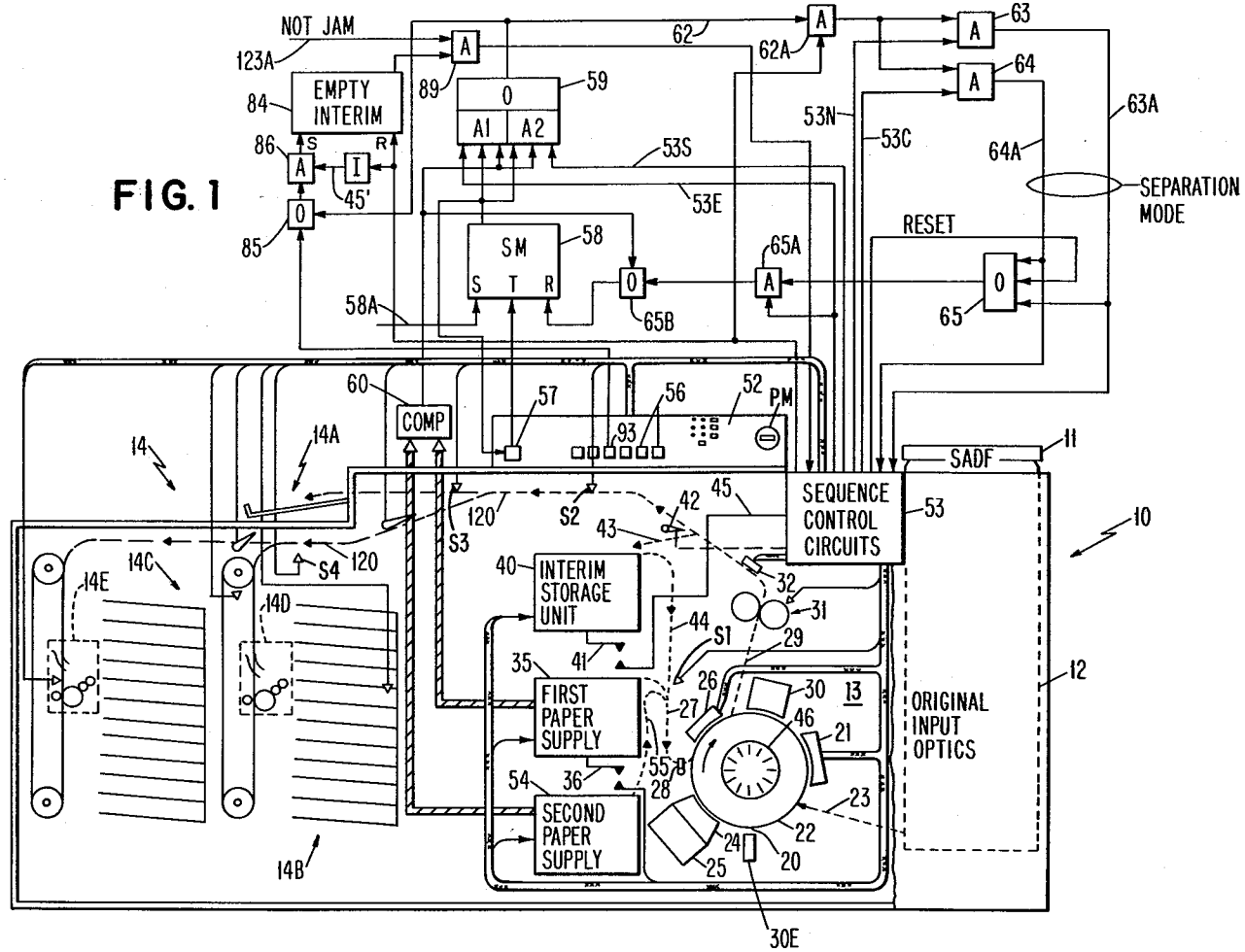
FIG. 1 is a logic diagram of a hardware circuit used with a a copier to practice the invention.

The details of the operation of the copy production machine 10 shown in FIG. 1 are described in the U.S. Pat. No. 4,086,658 patent incorporated herein by reference from column 3, line 16 to column 5, line 36.

Figure 2:
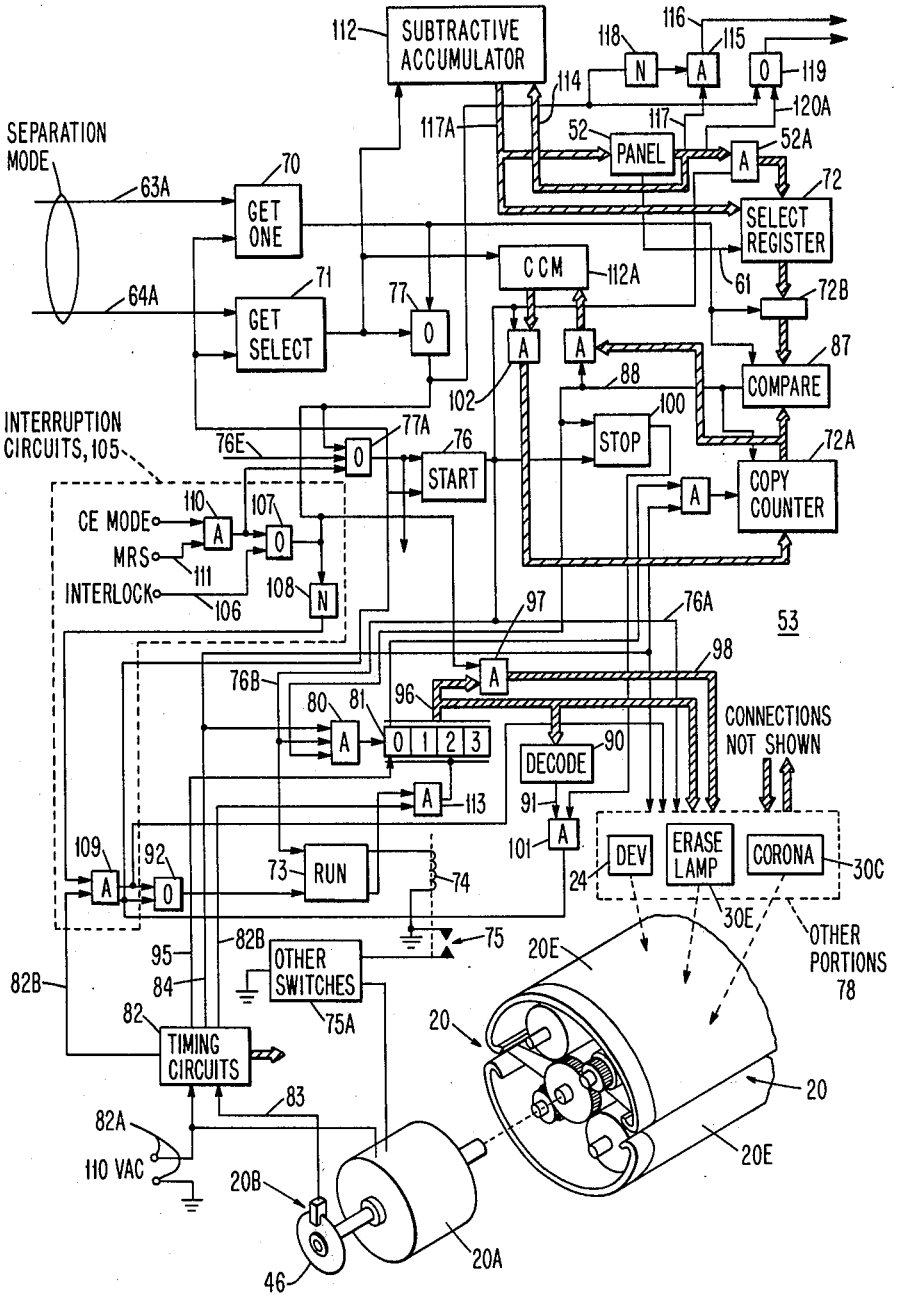
FIG. 2 is a logic diagram of an aspect for practicing the invention.
Figure 3:
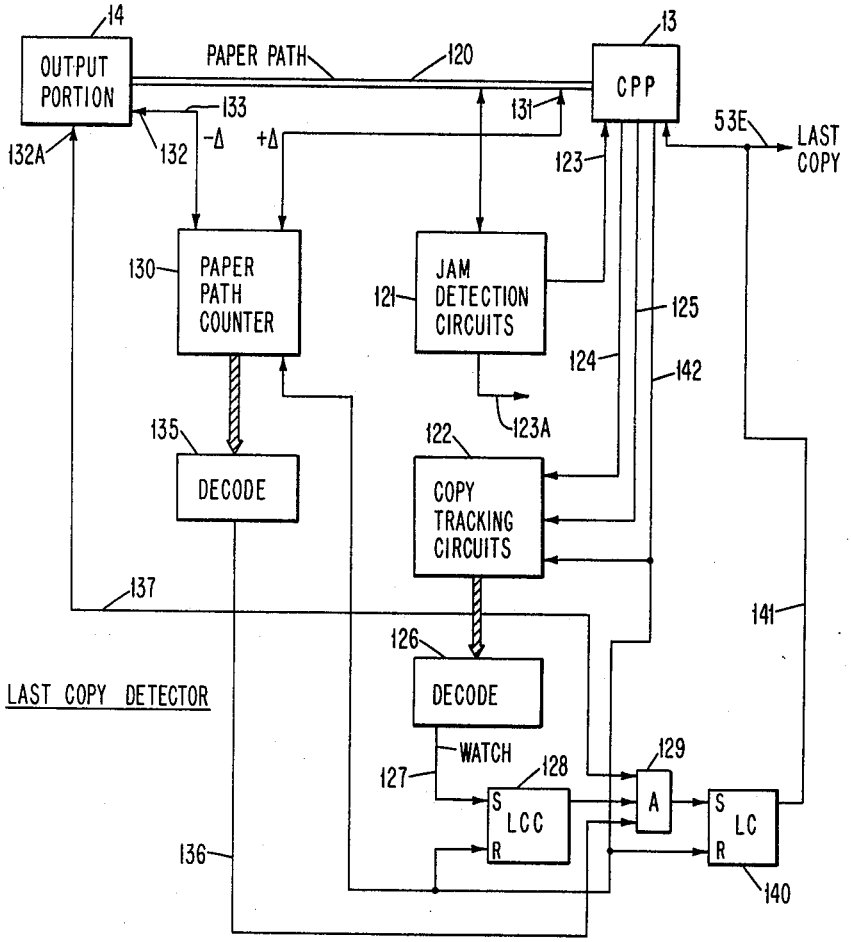
FIG. 3 is a logic diagram of a last copy detector circuit.

The operation of the logic circuits of FIGS. 1, 2, and 3 are explained in detail in the application Ser. No. 841,623 incorporated by reference.

The details of a suitable processor are shown in the U.S. Pat. No. 4,086,658 patent incorporated by reference from column 5, line 39, to column 22, line 11.

The following description shows in detail how the control functions of the circuits 53 are programmed on a suitable processor. The microcode tables provide the details of the steps shown in the flowcharts.

In FIG. 1, sensing switches S2, S3, S4 are shown at exit positions of the output section 14. These sensing switches indicate that a copy is leaving the copy production machine at its designated output port (termed a billing port) and is suitable to be billed or not to be billed, depending upon the status of copy production, i.e., whether copies are actually being produced or an auxiliary mode such as flush or separate runs is being performed.

The switch S1 adjacent the copy path 27 senses copy sheets entering the CPP 13. The position of S1 and of alternate paper supply 54 appear not to coincide; however, the copy sheets selected from supply 54 actually proceed past S1 before reaching the aligner gate 28. A pluggable billing meter PM may be installed in machine 10. It has a switch which signals to control 53 the fact that the PM meter is plugged in, allowing the machine to operate. If the PM meter is removed, the machine 10 will not operate.

Figure 4:
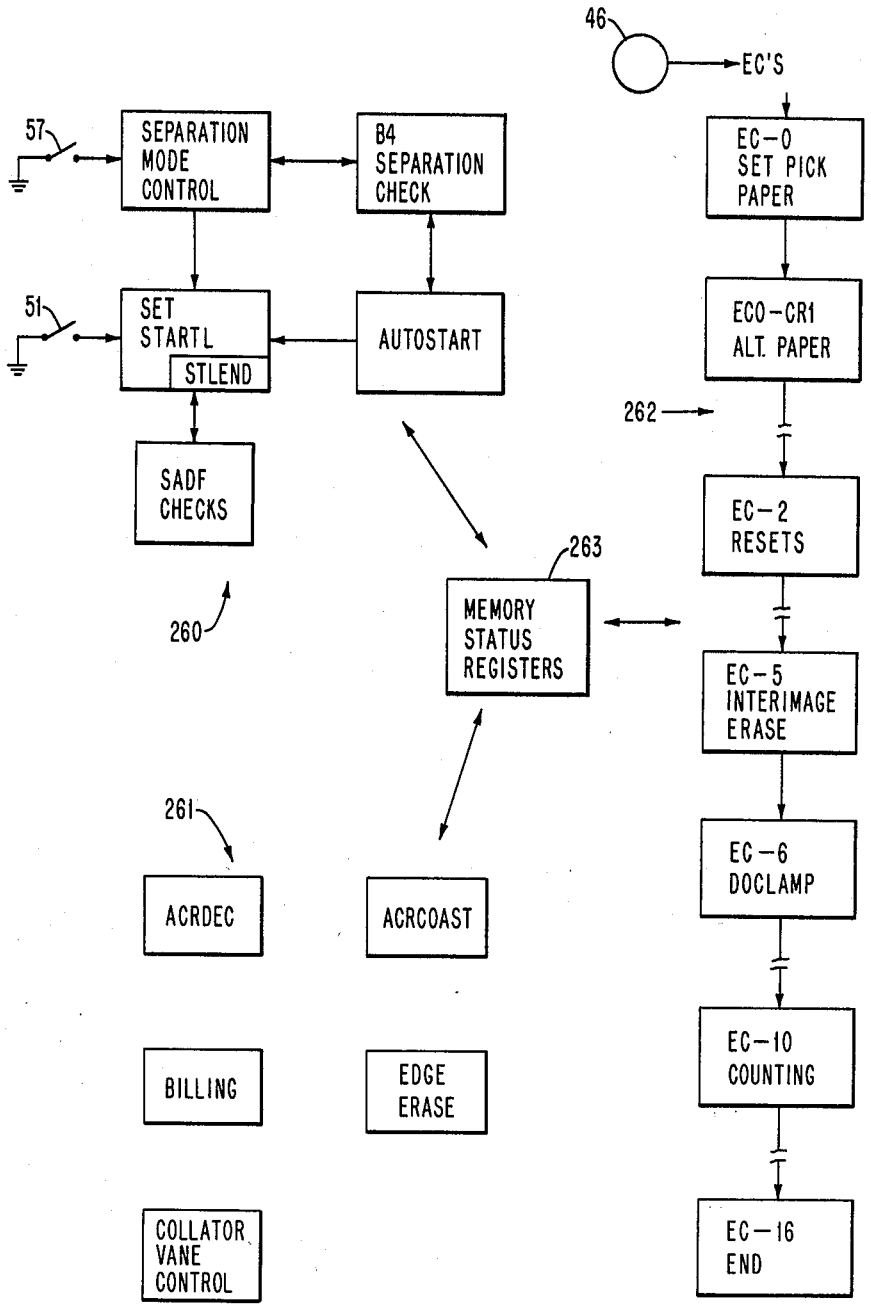
FIG. 4 is a block diagram showing the relationships of subroutines used in practicing the invention.

FIG. 4 is a simplified diagram of the various computer programs for the preferred embodiment. The programs are divided into two general categories, asynchronous and synchronous. This division eliminates the need for a master control program or an executive program as is usually required in the data processing and machine controller arts. In contrast to executive control, the program control to illustrate the present invention is timed to the operation of the copy production machine 10 so that the electromechanical portions of copy production machine 10 are synchronized to the drum 22 and the asynchronous programs to power line zero crossovers as detected by means not shown. Even while copies are being actively produced, the asynchronous programs 260, 261 are invoked by power line zero-crossovers for monitoring the operation of copy production machine 10 including the operator control panel 52. There are more asynchronous programs than shown in FIG. 4, those illustrated being limited to the computer programs related to the practice of the present invention.

The synchronous programs are invoked by timing signals from the emitter wheel 46 of the photoconductor drum 20. The emitter wheel 46 emits periodic pulses called emitter control pulses, ECs 0–16, for each image area. The photoconductor drum 20 preferably has two image areas, resulting in two sets of EC0–EC16 pulses for each rotation of the drum 20. The processor receives and counts the ECs using software techniques. A fiducial or synchronizing pulse (not shown) defines the image areas on the photoconductor drum 20. The EC count is reset upon the receipt of each fiducial pulse. For each image area being processed by the CPP 13, the control processor responds to its own software counting and interrupt signals to invoke one of the synchronous programs to be executed. For example, when EC0 is received, a plurality of programs are invoked because EC0 relates to a preparatory portion of each image cycle. Some of the EC0 programs will not be shown. At EC2, certain resets are employed in connection with practicing the separation mode. At EC5, the interimage erase controls are illustrated. EC6 controls the document lamp. At EC10, certain counts are effected for controlling the copy production machine 10 software architecture. The last EC, EC16, resets the separation mode at the end of a separation mode run and performs other functions not pertinent to the practice of the present invention. Communication between the synchronous programs, EC0–EC16, and the asynchronous programs 260, 261 is via the memory status registers or indicators designated in FIG. 4 as registers 263. When a separate button 57 is closed, the separate mode control enables the processor to sense its closure and to memorize the closure in a given location of the memory status registers 263. The computer also then invokes the B4 separation check program to ensure compatability of separation sheets with copy sheets. Closure of the start button 51 is sensed by the computer by executing SET STARTL (STARTL means start latch program). In connection with starting the copy production machine 10, the SADF 11 is checked for an original document at the preentry station. If copy production or separation mode has been interrupted, the autostart program enables the processor to restart automatically. This is explained below in more detail.

The asynchronous programs 261 enable the computer to extend logically the capacity of the collators 14B, 14C by allowing more than one collated set per collator bin. Other functions are performed by the computer in response to these stored programs for maximizing the efficiency of the copy production machine 10. All of these will become apparent from the following description.

In FIGS. 5–21, the flowchart step designation corresponds to the "LOC" designation of the source code in the corresponding program code tables included in this description. The flowchart will first be described and then the table included in the specification. For example, in FIG. 5, the step 5468 corresponds to an instruction in Table I at LOC 5468.

Figures 5, 13:
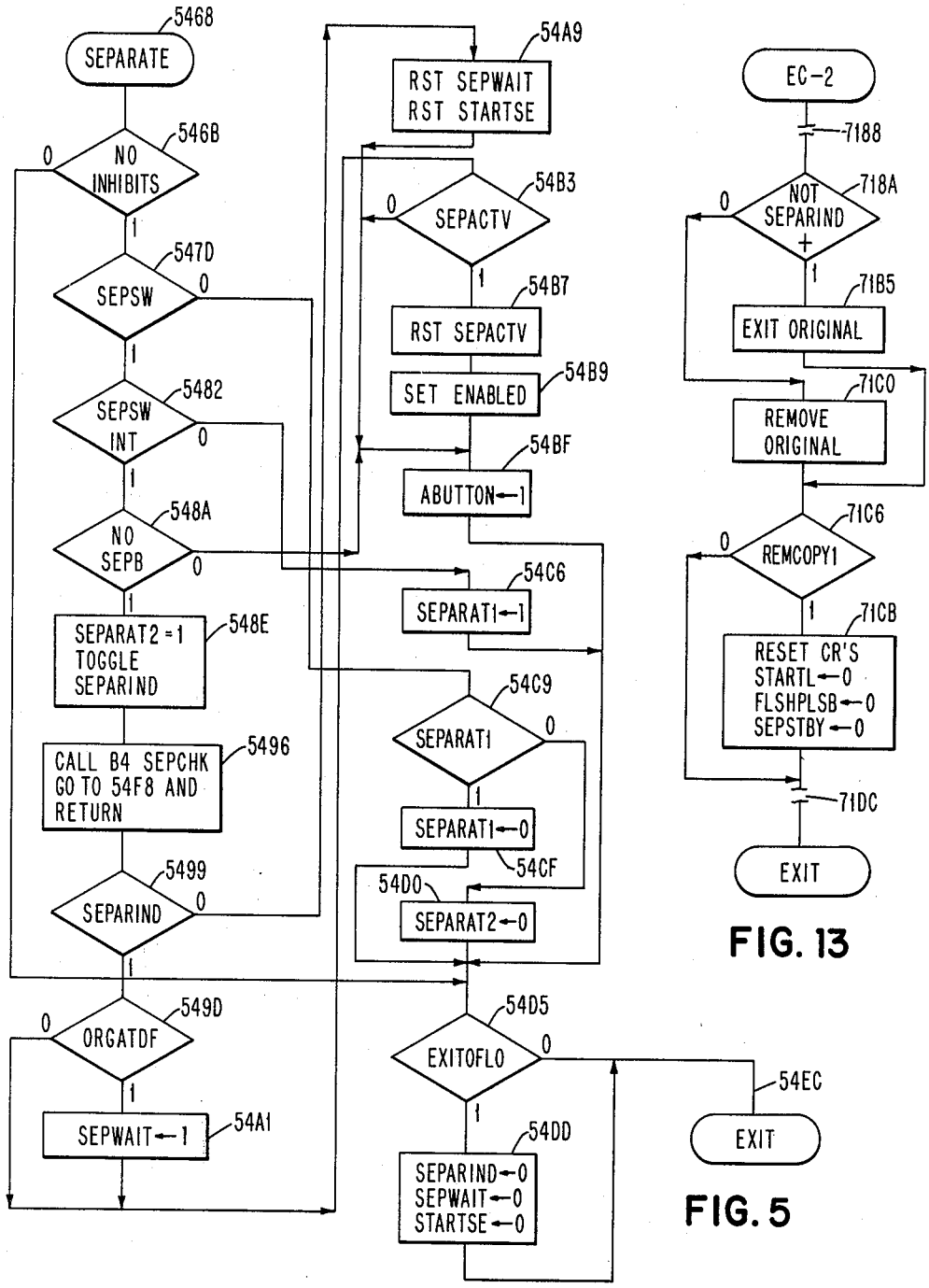
FIG. 5 is a flowchart of the SEPARATE routine.
FIG. 13 is a flowchart of the EC2 process.

In FIG. 5, the separate mode control is entered at the step 5468. First, the processor checks for inhibits by the step 546B, such inhibits being Check Paper Path (CPPIND) and the like. If any of the inhibits listed in Table I are active, the separation mode is not performed.

If there are no inhibits, at the step 547D, the processor checks whether the separation switch 57 (SEPSW) is being actuated. If so, the computer checks at the step 5482 whether the flag SEPARAT1 is set. This flag performs a switch closure integration. If SEPARAT1 is not set when SEPSW is actuated, then SEPARAT1 is set for the next pass. Requiring both the SEPSW and the SEPARAT1 to be active is the result of the SEPSW signal being present for two passes through the routine, i.e., about 33 milliseconds. This means the signal is not likely to be a transient.

At the step 548A, the processor checks whether the separate switch 57 had been previously serviced, indicated by SEPARAT2 being set. The programs operate at a speed such that the program could be executed several times while the SEPSW is actuated. It is imperative, however, that the actual steps to perform the separate function be executed only once per switch actuation. The SEPARAT2 flag is set when the steps are performed. Thereafter, testing the SEPARAT2 flag set indicates that the switch actuation has already been honored. If SEPARAT2 is reset at the step 548A, then at the step 548E, separate indicator SEPARIND flag is toggled to its opposite signal state and SEPARAT2 flag is set. At the step 5496, the processor calls the B4 separation check subroutine described below in more detail. At the step 5499, the processor checks the separate indicator. If reset, then the processor at the step 54A9 resets the SEParate WAIT flag and resets the START SEParate flag. If the separate indicator were set, at step 5499, then the processor checks by the step 549D whether an original is at the document feed (ORGATDF).

If there is an original at the document feed, then the separate run must wait until after the ensuing copy production run. The operator, by putting originals in SADF 11, inhibits the separation mode until the end of a set of copies is collated or produced. An original at the document feed causes the separate wait (SEPWAIT) flag to be set by the step 54A1. The flag SEPWAIT being set inhibits the execution of the separation mode.

From the step 54A1, the processor checks by the step 54B3 whether the separation mode is presently active (SEPACTV). If the separation mode is active, then the processor resets SEPACTV by the step 54B7 and sets the ENABLED flag by step 54B9. The ENABLED flag in the status registers 263 causes the processor to monitor the operator parameter selection switches on the control panel 52. By the step 54BF, the processor senses whether any button was activated on the panel 52. The processor branches from several points in the separate control program to the step 54BF.

The processor at the step 54D5 checks for exit overflow. Exit overflow means that the number of copies being made exceeds the capacity of the collators 14B, 14C and excess copies are being directed to the exit tray 14A. In the preferred embodiment, this action occurs only when the collate mode is selected after side 1 of a duplex job has been completed. Under other circumstances, the separation mode of this invention is employed. If there is no exit overflow, the processor exits the program at the step 54EC to execute the next asynchronous program. In the event of exit overflow, the instruction at the step 54DD enables the computer to reset the separate indicator, indicating that no separation is required or desired, and the SEParate WAIT and STARTSE flags. The processor then exits the routine at the step 54EC.

At the step 546B, if any inhibits are active, then the step 54D5 is executed, skipping the above-described intermediate steps.

If the separation switch 57 is sensed as not being actuated by the step 547D, then by the step 54C9, SEPARAT1 is tested and reset if set. This integrates the switch opening. If SEPARAT1 is reset, then SEPARAT2 is reset by the step 54D0. The flags are now ready for the next actuation of the SEPSW.

The program details for one implementation of the separate mode control program are set forth below in Table I. Column LOC lists the memory location of the machine instruction. The OBJ column contains the hexadecimal representation of the machine instruction. The OP1 and OP2 columns contain the operands 1 and 2, respectively. The source statement includes the mnemonics of the instruction, i.e., assembly language interleaved with comments representing a functional flowchart.

TABLE I

SEPARATION MODE CONTROL

| LOC | OBJ | OP1 | OP2 | SOURCE STATEMENT | | | |
|---|---|---|---|---|---|---|---|
| | | | | 1. CALL CHKINH CHECK FOR (¬CPPIND & ¬CKCOLTRI & ¬REMCOPYI & ¬PLSTNDBY) -- Check Inhibits | | | |
| 5468 | 31583A | 0001 | 3A58 | BAL | R1,CHKORG | | |
| | | | | 1. IF (NO INHIBITS FROM ABOVE) & ¬ADDPAPER & ¬ACRREQ & ¬(CEMODE>5) | | | |
| 546B | 3CD3 | 54D3 | | BNZ | SEP06 | | |
| | | | | TPB | PSB07,ADDPAPER | | |
| 546D | A647 | 0047 | | | | | |
| 546F | 94 | 0004 | | | | | |
| 5470 | 3CD3 | 54D3 | | BNZ | SEP06 | | *GO IF ACTIVE |
| | | | | TPB | PSB01,ACRREQ | | |
| 5472 | A641 | 0041 | | | | | |
| 5474 | 91 | 0001 | | | | | |
| 5475 | 3CD3 | 54D3 | | BNZ | SEP06 | | *GO IF SET |
| 5477 | A662 | 0062 | | LB | CEMODE | | GET CE MODE BYTE |
| 5479 | A805 | 0005 | | CI | 5 | | |
| 547B | 3ED3 | 54D3 | | BH | SEP06 | | *GO IF GREATER THAN 5 |
| | | | | 1.THEN | | | |
| | | | | 2. . IF SEPARATE (SEPARATION DEPRESSED) | | | |
| | | | | RIN | CSB05 | | GET STATUS |
| 547D | A6C4 | 00C4 | | | | | |
| 547F | 97 | 07 | | TP | SEPARATE | | TEST IF BEING PUSHED |
| 5480 | 3DC) | 54C9 | | BZ | SEP03 | | *GO IF NO |
| | | | | 2. . THEN | | | |
| | | | | 3. . . IF SEPARAT1 SEPARATION BEING INTEGRATED | | | |

TABLE I-continued

SEPARATION MODE CONTROL

```
LOC   OBJ    OP1   OP2   SOURCE STATEMENT
5482  A9A0   00A0         GI      INTOFF
5484  A641   0041         LB      PSB01          GET STATUS
5486  AF80   0007         TS      SEPARAT1       TEST IF SET
5488  3DC6   54C6         BZ      SEP02          *GO IF NO
                       3. . . THEN
                       4. . . . IF ¬SEPARAT2 SEPARATION NOT HONORED
548A  AF40   0008         TS      SEPARAT2
548C  3CBF   54BF         BNZ     SEP01A         *GO IF YES -- Separate Pushed
                       4. . . . THEN
                       5. . . . . SEPARAT2=1
548E  A141   0041         STB     PSB01          UPDATE
                       5. . . . . TOGGLE SEPIND -- Memorize
5490  A677   0077         LB      PCB06          GET STATUS
5492  AD04   0004         XI      P1(SEPARIND)
5494  A177   0077         STB     PCB06          UPDATE
                       5. . . . . CALL B4SEPCHK GO CHECK B4 SEPARATION
5496  33F854 0003  54F8   BAL     R3,B4SEPCHK
                       5. . . . . IF SEPARIND
                            TPB     PCB06,SEPARIND
5499  A677   0077
549B  92     0002
549C  49     5489         JZ      SEP01          *GO IF NO
                       5. . . . . THEN
                       6. . . . . . IF ORGATDF
                            RIN     CSB09          GET STATUS
549D  A6D0   00D0
549F  94     0004         TP      ORGATDF        TEST IF DOC A SADF
54A0  49     54A9         JZ      SEP01          *GO IF NO
                       6. . . . . . THEN
                       7. . . . . . . SEPWAIT=1
                            TSB     PCB01,SEPWAIT
54A1  A641   0041  --     Separate waits for
54A3  AF20   0005         next run.
54A5  A141   0041
                       6. . . . . . ENDIF
54A7  2CBF   54BF         B       SEP01A         *GO
                       5. . . . . ELSE
             54A9    SEP01 DC
                       6. . . . . . RESET SEPWAIT,STARTSE
                            TRB     PSB01,SEPWAIT
54A9  A641   0041
54AB  B5     0005
54AC  A141   0041
                            TRB     PSB07,STARTSE
54AE  A647   0047
54B0  B7     0007
54B1  A147   0047
                       6. . . . . . IF SEPACTV
54B3  A647   0047         LB      PSB07
54B5  B3     0003         TR      SEPACTV
54B6  4F     54BF         JZ      SEP01A
                       6. . . . . . THEN
                       7. . . . . . . RESET SEPACTV
54B7  A147   0047         STB     PSB07
                       7. . . . . . . SET ENABLED
                            TSB     PSB42,ENABLED
54B9  A66A   006A
54BB  AF80   0007
54BD  A16A   006A
                       6. . . . . . ENDIF
                       5. . . . . ENDIF
                       4. . . ENDIF
             54BF    SEP01A DC      *
                       4. . . ABUTTON=1
                            TSB     PSB28,ABUTTON
54BF  A65C   005C
54C1  AF02   0001
54C3  A15C   005C
54C5  03     54D3         J       SEP06
                       3. . ELSE
             54C6    SEP02  DC      *
                       4. . . SEPARAT1=1
54C6  A141   0041         STB     PSB01          UPDATE
                       3. . ENDIF
54C8  03     54D3         J       SEP06
                       2. . ELSE
             54C9    SEP03  DC      *
                       DEINTEGRATION OF SEPARATION SWITCH
                       3. . IF SEPARAT1
```

TABLE I-continued

SEPARATION MODE CONTROL

```
LOC   OBJ   OP1   OP2   SOURCE STATEMENT
54C9  A9A0  00A0        GI     INTOFF
54CB  A641  0041        LB     PSB01          GET STATUS
54CD  B7    0007        TR     SEPARAT1       TEST IF SET
54CE  40    54D0        JZ     SEP04          *GO IF NO
                  3. . THEN
                  4. . . . SEPARAT1=0
54CE  01    54D1        J      SEP05
                  3. . ELSE
            54D0  SEP04 DC     *
                  4. . . . SEPARAT2=0
54D0  B6    0006        TR     SEPARAT2
                  3. . ENDIF
            54D1  SEP05 DC     *
54D1  A141  0041        STB    PSB01          UPDATE
                  2. . ENDIF
                  1. ENDIF
            54D3  SEP06 DC     *
54D3  A920  0020        GI     INTON          UNMASK INTERRUPTS
                  1. IF EXITOFLO
                        SRG    COLRG
54D5  A9D0  00D0
                        TPB    CPSB05,EXITOFLO
54D7  A616  0016
54D9  95    0005
54DA  A989  0089        GI     INTOFFCG+BASERG
54DC  4C    54BC        JZ     SEP10
                  1. THEN
                  2. . SEPARIND=0
                        TRB    PCB06,SEPARIND
54DD  A677  0077
54DF  B2    0002
54E0  A177  0077
                  2. . SEPWAIT,STARTSE
                        TRB    PSB01,SEPWAIT
54E2  A641  0041
54E4  B5    0005
54E5  A141  0041
                        TRB    PSB07,STARTSE
54E7  A647  0047
54E9  B7    0007
54EA  A147  0047
                  1. ENDIF
            54E2        DC     *
54EC  A920  0020        GI     INTON
                  ENDBEGIN SEPARATE
```

Figure 6:
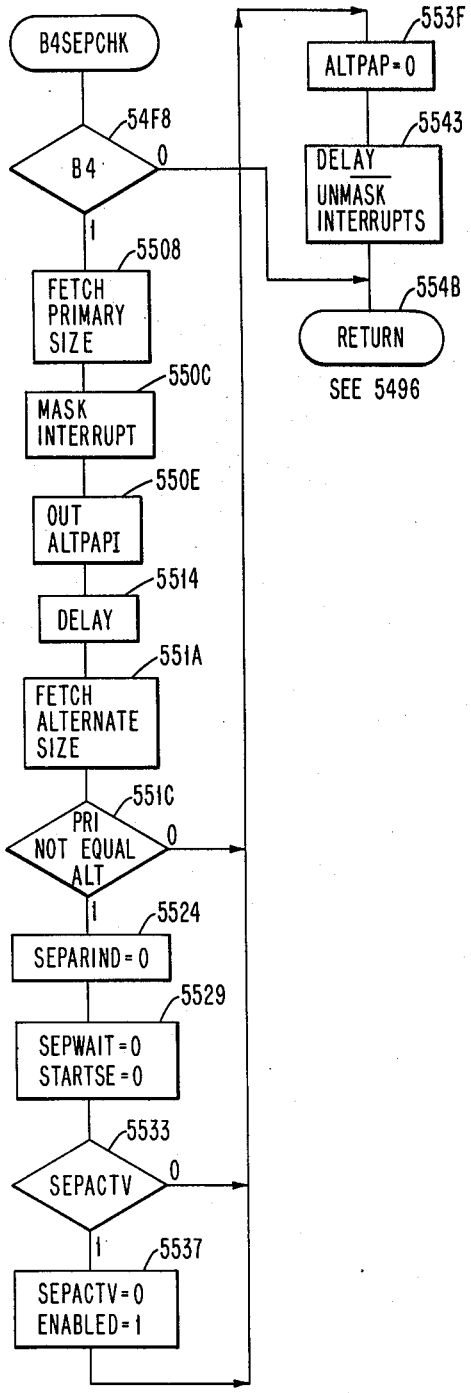
FIG. 6 is a flowchart of the B4SEPCHK subroutine.

The flowchart in FIG. 6 represents the routine for checking proper separation sheet size. At the step 54F8, the processor checks whether the copy production machine is designed to handle B4 size paper (Japanese). If not, there is no need to inhibit any size of separation sheet and the processor exits the program at the step 554B. RETURN is the last step of an off-line subroutine, causing program control to return to the instruction calling the subroutine. This subroutine was called in the step 5496 of the SEPARATE routine in FIG. 5.

When checking for proper sheet sizes for certain nations, the processor at the step 5508 fetches the primary size, i.e., the size of copy sheets on which images are being produced. During this checking, interrupts are masked beginning at the step 550C. At the step 550E, the second paper supply or alternate paper bin 54 is selected. The delay of the step 5514 allows the selection to be completed. At the step 551A, the alternate size, i.e., the size of copy sheets in the second paper supply 54, is determined. If the size of copy sheets indicated for the primary bin 35 is not the same as that indicated for second paper supply 54, then the separation indicator is reset by the step 5524, i.e., the separation mode is inhibited. At the step 5529, the SEPWAIT and STARTSE flags are also reset and at the step 5533, the SEPACTV flag is checked. If it is set, it is reset by the step 5537 and the ENABLED flag is set. At the step 553F, the ALTernate PAPer flag is reset with a deselection delay and the interrupts being unmasked at the step 5543.

TABLE II

PAPER SIZE CHECK

```
LOC   OBJ   OP 1   OP 2   SOURCE STATEMENT
            54F8          ORG        B4SEPCHK
                            BEGIN B4SEPCHK
                            1. TEXT
                               THIS SUBROUTINE GUARANTEES THAT THE LARGEST, SMALLEST
                               AND INTERMEDIATE B4 PAPER SIZES WILL NOT BE MIXED BY
                               SEPARATION MODE ON B4 MACHINES WHILE COLLATE IS SELECTED.
                               REGISTERS USED:
                                  R0 LOW
                                  R3 LINKAGE
```

TABLE II-continued

PAPER SIZE CHECK

```
LOC   OBJ   OP 1   OP 2        SOURCE STATEMENT
                                     R8 ALL
                                1. ENDTEXT
                                1. IF (B4 &COLATIND 6SEPARIND & ¬ALTPAPI
54F8  A6A1  01A1                     LBL    COUNTRY
54FA  92    0002                     TP     B4
54FB  46    5506                     JZ     SEPCHK10
54FC  A677  0077                     LB     PCB06
54FE  91    0001                     TP     COLATIND
54FF  46    5506                     JZ     SEPCHK10
5500  92    0002                     TP     SEPARIND
5501  46    5506                     JZ     SEPCHK10
                                     TPB    PCB05, ALTPAPI
5502  A676  0076
5504  91    0001
5505  48    5508                     JZ     SEPCHK20
            5506          SEPCHK10 DC     *
5506  3C4B  554B                     B      SEPCHK45
                                1. THEN
            5508          SEPCHK20 DC     *
                                2. . INPUT PRIMARY BIN SIZE AND SAVE
                                     RIN    CSB13
5508  A6D4  00D4
550A  A120  0120                     STBL   BASER0LO
                                2. . MASK INTERRUPTS
550C  A9A0  00A0                     GI     INTOFF
                                2. . OUTPUT ALTPAPI=1
550E  A676  0076                     LB     PCB05
5510  AF02  0001                     TS     ALTPAPI
                                     ROUT   CCB05
5512  A1C4  00C4
                                2. . DELAY 115 MICROSECS
                                     ZLI    4
5514  25
5515  AE04  0004
5517  88    0008                     STR    R8
            5518          SEPCHK25 DC     *
5518  F8    0008                     LRD    R8
5519  78    5518                     JNZ    SEPCHK25
                                2. . INPUT ALTERNATE BIN SIZE
                                     RIN    CSB13
551A  A6D4  00D4
                                2. . IF (ALTERNATE CONTAINS B5 OR PRIMARY SELPAPE ¬= ALTERNATE
                                                SELPAPE)
551C  AB1E  001E                     NI     P (SELPAPE, SELPAPD, SELPAPC, SELPAPB)
551E  44    5524                     JZ     SEPCHK30     * GO IF B5
551F  A520  0120                     SBL    BASER0LO
5521  94    0004                     TP     SELPAPE
5522  3D3F  553F                     BZ     SEPCHK35     * GO IF THEY AGREE
                                2. . THEN
            5524          SEPCHK30 DC     *
                                3. . . SEPARIND=0
                                     TRB    PCB06, SEPARIND
5524  A677  0077
5526  B2    0002
5527  A177  0077
                                3. . . SEPWAIT, STARTSE=0
                                     TRB    PSB01, SEPWAIT
5529  A641  0041
552B  B5    0005
552C  A141  0041
                                     TRB    PSB07, STARTSE
552E  A647  0047
5530  B7    0007
5531  A147  0047
                                3. . .IF SEPACTV
5533  A647  0047                     LB     PSB07
5535  B3    0003                     TR     SEPACTV
5536  4F    553F                     JZ     SEPCHK35
                                3. . . THEN
                                4. . . . RESET SEPACTV
5537  A147  0047                     STB    PSB07
                                4. . . . SET ENABLED
                                     TSB    PSB42, ENABLED
5539  A66A  006A
553B  AF80  0007
553D  A16A  006A
                                3. . . ENDIF
                                2. . ENDIF
            553F          SEPCHK35 DC     *
                                2. . OUTPUT     ALTPAPI=0
```

TABLE II-continued

PAPER SIZE CHECK

| LOC | OBJ | OP 1 | OP 2 | SOURCE STATEMENT |
|---|---|---|---|---|
| 553F | A676 | 0076 | | LB PCB05 |
| | | | | ROUT CCB05 |
| 5541 | A1C4 | 00C4 | | |
| | | | | 2. . DELAY 115 MICROSECS |
| | | | | ZLI 4 |
| 5543 | 25 | | | |
| 5544 | AE04 | 0004 | | |
| 5546 | 88 | 0008 | | STR R8 |
| | | 5547 | | SEPCHK40 DC * |
| 5547 | F8 | 0008 | | LRD R8 |
| 5548 | 77 | 5547 | | JNZ SEPCHK40 |
| | | | | 2. . UNMASK INTERRUPTS |
| 5549 | A920 | 0020 | | GI INTON |
| | | | | 1. ENDIF |
| | | 554B | | SEPCHK45 DC * |
| | | | | RETURN TO CALLER |
| 554B | 23 | 0003 | | RTN R3 |
| | | | | ENDBEGIN B4SEPCHK |

Figures 7, 10:
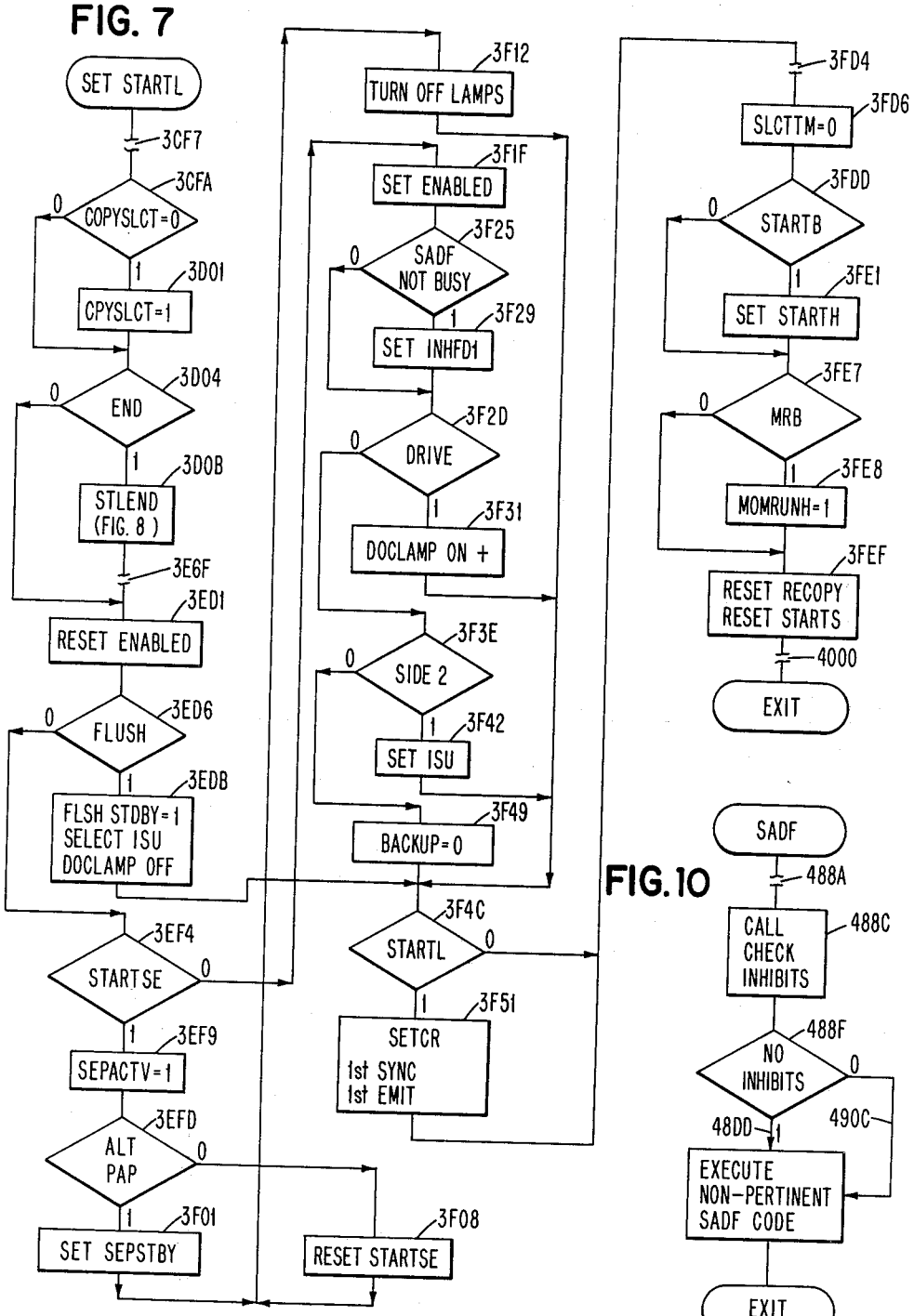
FIG. 7 is a flowchart of the SET STARTL subroutine.
FIG. 10 is a flowchart of the SADF process.

The START Latch (STARTL) routine is flowcharted in FIG. 7 and the program details are shown in Table III. The program is invoked in response to the actuation of the start button on the panel 52 or by the insertion of an original document into the SADF 11. Before the START Latch in the copy production machine is activated, several functions must be performed that are not pertinent to a description of the invention. For example, nonpertinent code is indicated at various memory locations such as 3CF7, 3E6F, 3FD4, and 4000.

The processor first checks by the step 3CFA whether the COPY SeLeCTion value is zero. If so, then a minimum value of one is set for copy production at the step 3D01. The END flag, signifying the end of a copy producing run, is checked by the step 3D04. The END flag is set if a copy production run ends normally, i.e., was not terminated because of no paper in the supply or the like. If the END flag is set, the STLEND routine, identified as step 3D0B, is executed as later described in more detail.

Before starting copy production, the processor resets the ENABLED flag by the step 3ED1. The ENABLED flag being reset indicates that the processor shall not honor any selections from the panel 52, the only exception being the STOP button which overrides the START button.

The processor checks by the step 3ED6 whether the FLUSH flag is set. If set, the FLUSH flag signifies that copies in the ISU 40 are to be removed to the output section 14 without receiving second images. If the flag is set, then the processor by the step 3EDB sets the FLuSH STanDBY flag, selects the ISU as the source of copy sheets to be transported to the output section 14, and turns off the DOCument LAMP.

The document lamp (not shown) scans the original document on the platen (not shown) of the SADF 11 to transfer an optical image of the document onto the photoconductor drum 20. By the step 3F4C, the processor checks whether the START Latch is set. If it is already set, then at the step 3F51 the processor sets a copy register CR (not shown) in the working memory 172 and waits for a first sync and a first emit pulse from the emitter wheel 46. The status of the CR register is not pertinent to the operation of the separation mode but is important in copy production. Since machine state registers are well known in copy production machines, further discussion is not required.

After executing nonpertinent code at location 3FD4, the processor clears the button select time (SLCTTM) to zero so that a button depression timeout can be initiated. At the step 3FDD, the START Button is sensed. If actuated, the STARTB flag is set by the step 3FE1. The momentary run button (MRB) is sensed by the step 3FE7. (MRB is not shown in the drawing.) If the MRB flag is set, then the flag MOMRUNH is set indicating that the momentary run button has been actuated.

At the step 3FEF, the processor resets all the recopy lights (not shown) which display to the operator the number of documents to be recopied for error recovery and resets the STARTS flag. The various START Latches are program flags for synchronizing the startup procedure and each occupies one bit position in a register within the memory 172. The processor exits the program via the nonpertinent code at location 4000.

At the step 3ED6, if no flush operation is to be performed, then the step 3EF4 determines whether a separation mode is to be started (STARTSE). If not, the step 3F1F sets the ENABLED flag to permit the operator to insert operating parameters via the panel 52. By the step 3F25, the processor checks whether the SADF 11 is busy. If not, then the flag INHFD1 is set by the step 3F29. The flag INHFD1 indicates that an operator has lifted the lid (not shown) of SADF 11 to place an original to be copied on the platen (not shown) of the SADF 11. The status of the main drive motor (not shown) for the machine 10 is sensed by the step 3F2D. If the motor is on, then the document lamp (not shown) is turned on by the step 3F31 to scan the original document which is in copying position within SADF 11, whether manually or inserted.

If the motor is off at the step 3F2D, then the processor checks for a SIDE 2 indicator by the step 3F3E. If the second side is to be produced, i.e., if the ISU 40 is to be the source of the copy sheets for duplex copy production, then the processor at the step 3F42 selects the ISU 40 as the source of copy sheets. If the flag SIDE 2 is reset, then the copies to be produced in the ensuing copy production run are either simplex or the first side of duplex to be directed to the interim storage unit 40. The backup register in the memory 172 is cleared to zeros by the step 3F49 to indicate that the original document in the SADF 11 to be copied is the first image in a possible series of images. From the step 3F49, the processor executes the previously described code beginning at the step 3F4C.

When the separation mode flag indicates that a separation run is to be performed, then by the step 3EF9, the processor sets the SEPACTV flag to indicate that the separation mode is active. The processor checks by the step 3EFD whether the alternate paper supply 54 has been selected. If it has been selected, then the separation standby flag SEPSDBY is set by the step 3F01. Otherwise, the STARTSE flag is reset by the step 3F08, requiring that the alternate paper supply 54 be selected before the separation mode can ensue. At the step 3F12, the processor turns off the document lamp (not shown) because no copies are to be made. The processor reaches the step 3F4C previously described.

The above program is shown in detail in the following Table III.

TABLE III

SET START LATCH

| LOC | OBJ | OP1 | OP2 | | SOURCE STATEMENT |
|---|---|---|---|---|---|
| | | | | | NONPERTINENT CODE |
| | | | | | 2. . IF COPY SELECT = 0 |
| 3CFA | 24 | | | | CLA |
| CFB | A009 | 0009 | | | CB CPYSLLO |
| 3CFD | 64 | 3D) 4 | | | JNZ STAR025 |
| 3CFE | A019 | 0019 | | | CB CYPSLHI |
| 3D00 | 64 | 3D04 | | | JNZ STAR025 |
| | | | | | 2. . THEN |
| | | | | | 3. . . SET COPY SELECT = 1 |
| 3D01 | 2E | | | | A1 |
| 3D02 | A109 | 0009 | | | STB CPYSLLO |
| | | | | | 2. . ENDIF |
| | | | | STAR025 | EQU * |
| | | | | | 2. . IF END (PREVIOUS RUN COMPLETED NORMALLY) |
| 3D04 | A643 | 0043 | | | LB PSB03 |
| 3D06 | B7 | 0007 | | | TR END |
| 3D07 | 6B | 3D0B | | | JNZ STAR031X |
| 3D08 | 30D13E | 3ED1 | 0000 | | BU STAR031,R0 |
| | | | | | 2. . THEN |
| | | | | STAR031X | EQU * |
| | | | | | 3. . . PROCESS STEND PERFORMS CODE REQUIRED WHEN STARTL IS SET & END IS ON |
| | | | | | SEE TABLE XX |
| | | | | STAR031 | EQU * |
| | | | | | 2. . RESET ENABLED |
| | | | | | TRB PSB42,ENABLED |
| 3ED1 | A66A | 006A | | | |
| 3ED3 | B7 | 0007 | | | |
| 3ED4 | A16A | 006A | | | |
| | | | | | 2. . IF FLUSH |
| | | | | | TPB PSB07,FLUSH |
| 3ED6 | A647 | 0047 | | | |
| 3ED8 | 91 | 0001 | | | |
| 3ED9 | 3DF4 | 3EF4 | | | BZ STAR034 |
| | | | | | 2. . THEN |
| | | | | | 3. . . SET FLUSH PLEASE STANDBY |
| | | | | | TSB PSB19,FLSHPLSB |
| 3EDB | A653 | 0053 | | | |
| 3EDD | AF04 | 0002 | | | |
| 3EDF | A153 | 0053 | | | |
| | | | | | 3. . . PICK DUPLEX TRUCK |
| | | | | | TSB PCB02,DPLXTRCK |
| 3EE1 | A673 | 0073 | | | |
| 3EE3 | AF04 | 0002 | | | |
| 2EE5 | A173 | 0073 | | | |
| | | | | | 3. . . TURN OFF DOCUMENT LAMP |
| | | | | | TRB PCB12,DOCLAMP |
| 3EE7 | A67C | 007C | | | |
| 3EE9 | B4 | 0004 | | | |
| 3EEA | A17C | 007C | | | |
| | | | | | 3. . . TURN OFF ALL EDGE ERASE LAMPS (ERS0, ERS1, ERS2, ERS3, B4ERS3, B4ERSR1, B4ERSR2) |
| | | | | | TRMB PCB01,P(ERS0,ERS1,ERS2,ERS3,B4ERS3,BR34SR1,B4ERSR2) |
| 3EEC | A672 | 0072 | | | |
| 3EEE | AB01 | 0001 | | | |
| 3EF0 | A712 | 0072 | | | |
| 3EF2 | 244C | 3F4C | | | B STARC00 |
| | | | | | 2. . ELSE |
| | | | | STAR034 | EQU * |
| | | | | | 3. . . IF STARTSE |
| | | | | | TPB PSB07,STARTSE |
| 3EF4 | A647 | 0047 | | | |
| 3EF6 | 97 | 0007 | | | |
| 3EF7 | 351F | 3F1F | | | BZ STAR034A |
| | | | | | 3. . . THEN |
| | | | | | 4. . . . SET SEPACTV |
| 3EF9 | AF08 | 0003 | | | TS SEPACTV |
| 3EFB | A147 | 0047 | | | STB PSB07 |
| | | | | | 4. . . . IF PAPER PRESENT IN ALTERNATE BIN (CHECK PAPER PRESENT SW DIRECTLY) |

TABLE III-continued

SET START LATCH

| LOC | OBJ | OP1 | OP2 | SOURCE STATEMENT |
|---|---|---|---|---|
| | | | | RIN CSB04 |
| 3EFD | A6C3 | 00C3 | | |
| 3EFF | 97 | 0007 | | TP ALTPRES |
| 3F00 | 48 | 3F08 | | JZ STARI01 |
| | | | | 4. . . . THEN |
| | | | | 5. . . . . SET SEPSTBY |
| | | | | TSB PLSTNDBY,SEPSTBY |
| 3F01 | A653 | 0053 | | |
| 3F03 | AF20 | 0005 | | |
| 3F05 | A153 | 0053 | | |
| 3F07 | 02 | 3F12 | | J STARI02 |
| | | | | 4. . . . ELSE |
| | | | STARI01 | EQU * |
| | | | | 5. . . . . RESET STARTSE,STARTL |
| | | | | TRB PSB22,STARTL |
| 3F08 | A656 | 0056 | | |
| 3F0A | B6 | 0006 | | |
| 3F0B | A156 | 0056 | | |
| | | | | TRB PSB07,STARTSE |
| 3F0D | A647 | 0047 | | |
| 3F0F | B7 | 0007 | | |
| 3F10 | A147 | 0047 | | |
| | | | | 4. . . . ENDIF |
| | | | STARTI02 | EQU * |
| | | | | 4. . . . TURN OFF DOCUMENT LAMP |
| | | | | TRB PCB12,DOCLAMP |
| 3F12 | A67C | 007C | | |
| 3F14 | B4 | 0004 | | |
| 3F15 | A17C | 007C | | |
| | | | | 4. . . . TURN OFF ALL EDGE ERASE LAMPS (ERS0, ERS1, ERS2, ERS3, B4ERS3, B4ERSR1, B4ERSR2) |
| | | | | TRMB PCB01,P(ERS1,ERS2,ERS3,B4ERS3,B4ERSR1,B4ERSR2) |
| 3F17 | A672 | 0072 | | |
| 3F19 | AB01 | 0001 | | |
| 3F1B | A172 | 0072 | | |
| 3F1D | 2C4C | 3F4C | | B STARC00 |
| | | | | 3. . . ELSE |
| | | | STAR034A | EQU * |
| | | | | 4. . . . SET ENABLED |
| | | | | TSB PSB42,ENABLED |
| 3F1F | A66A | 006A | | |
| 3F21 | AF80 | 0007 | | |
| 3F23 | A16A | 006A | | |
| | | | | 4. . . . IF SADFBUSY |
| | | | | TPB PSB31,SADFBUSY |
| 3F25 | A65F | 005F | | |
| 3F27 | 93 | 0003 | | |
| 3F28 | 6D | 3F2D | | JNZ STAR034B |
| | | | | 4. . . . THEN |
| | | | | 5. . . . . SET INHFD1 |
| 3F29 | AF20 | 0005 | | TS INHFD1 |
| 3F2B | A15F | 005F | | STB PSB31 |
| | | | | 4. . . . ENDIF |
| | | | STAR034B | EQU * |
| | | | | 4. . . . IF DRIVE |
| | | | | TPB PSB21,DRIVE |
| 3F2D | A655 | 0055 | | |
| 3F2F | 90 | 0000 | | |
| 3F30 | 4E | 3F3E | | JZ STAR049 |
| | | | | 4. . . . THEN |
| | | | | 5. . . . . OUTPUT - TURN ON DOCUMENT LAMP |
| | | | | TSB PCB12,DOCLAMP |
| 3F31 | A67C | 007C | | |
| 3F33 | AF10 | 0004 | | |
| 3F35 | A17C | 007C | | |
| | | | | NONPERTINENT INSTRUCTION |
| 3F37 | A66F | 006F | | |
| 3F39 | AF10 | 0004 | | |
| 3F3B | A16F | 006F | | |
| 3F3D | 0C | 3F4C | | |
| | | | | 4. . . . ELSE |
| | | | STAR049 | EQU * |
| | | | | 5. . . . . IF SIDE-2 |
| | | | | TPB PSB20,DPXSIDE2 |
| 3F3E | A654 | 0054 | | |
| 3F40 | 95 | 0005 | | |
| 3F41 | 49 | 3F49 | | JZ STAR032A |
| | | | | 5. . . . . THEN |
| | | | | 6. . . . . PICK DUPLEX TRUCK |
| | | | | TSB PCB02,DPLXTRCK |

TABLE III-continued

SET START LATCH

```
LOC   OBJ   OP1   OP2          SOURCE STATEMENT
3F42  A673  0073
3F44  AF04  0002
3F46  A173  0073
3F48  0C    3F4C                 J        STAR032B
                            5. . . . . ELSE
                      STAR032A   EQU      *
                            6. . . . . . BACKUP=0
3F49  25                         CLA
3F4A  A16C  006C                 STB      BACKUP
                            5. . . . . ENDIF
                      STAR032B   EQU      *
                            4. . . . ENDIF
                      STAR032    EQU      *
                            3. . . ENDIF
                            2. . ENDIF
                      STARC00    EQU      *
                            1. ENDIF
                      STAR033    EQU      *
                            1. IF STARTL
                                 TPB      PSB22,STARTL
3F4C  A656  0056
3F4E  96    0006
3F4F  3DD4  3FD4                 BZ       STARI00
                            1. THEN
                            2. . PROCESS SETCR SETS APPROPRIATE CR BIT & 1ST SYNC & 1ST EMIT
                            NONPERTINENT CODE
                            1. SLCTTM=0 -(PREVENTS NUMERIC SELECTION); NEWSLCT=1 -(NEXT
                                      NUMERIC BUTTON IS 1ST)
3FD6  A66A  006A                 LB       PSB42
3FD8  B1    0001                 TR       SLCTTM
3FD9  AF10  0004                 TS       NEWSLCT
3FDB  A16A  006A                 STB      PSB42
                            1. IF STARTB
                                 TPB      PSB22,STARTB
3FDD  A656  0056
3FDF  95    0005
3FE0  47    3FE7                 JZ       STAR034C
                            1. THEN
                            2. . SETSTARTH (START BUTTON HONORED)
                                 TSB      PSB23,STARTH
3FE1  A657  0057
3FE3  AF10  0004
3FE5  A157  0057
                            1. ENDIF
                      STAR034C   EQU      *
                            1. IF MOMRUNB
                                 TPB      PSB21,MOMRUNB
3FE7  A655  0055
3FE9  95    0005
3FEA  4F    3FEF                 JZ       STAR024
                            1. THEN
                            2. . MOMRUNH =1 (REQUIRES MOMRUN BUTTON TO BE RELEASED BEFORE
                                      STARTL CAN BE SET AGAIN)
3FEB  AF08  0003                 TS       MOMRUNH
3FED  A155  0055                 STB      PSB21
                            1. ENDIF
                      STAR024    EQU      *
                            1. RESET ALL RECOPY LIGHTS
                                 TRMB     PCB13,P(RECOPY1,RECOPY2,RECOPY3)
3FEF  A67D  007D
3FF1  AB7C  007C
3FF3  A17D  007D
                      1. RESET STLREQ, STARTDF, STARTFL, STARTPC, STARTSE
                                 TRMB     PSB22,P(STLREQ,STARTDF,STARTFL,STARTPC)
3FF3  A656  0056
3FF7  AB74  0074
3FF9  A156  0056
                                 TRB      PSB07,STARTSE
3FFB  A647  0047
3FFD  B7    0007
                            NONPERTINENT CODE
```

Figure 8:
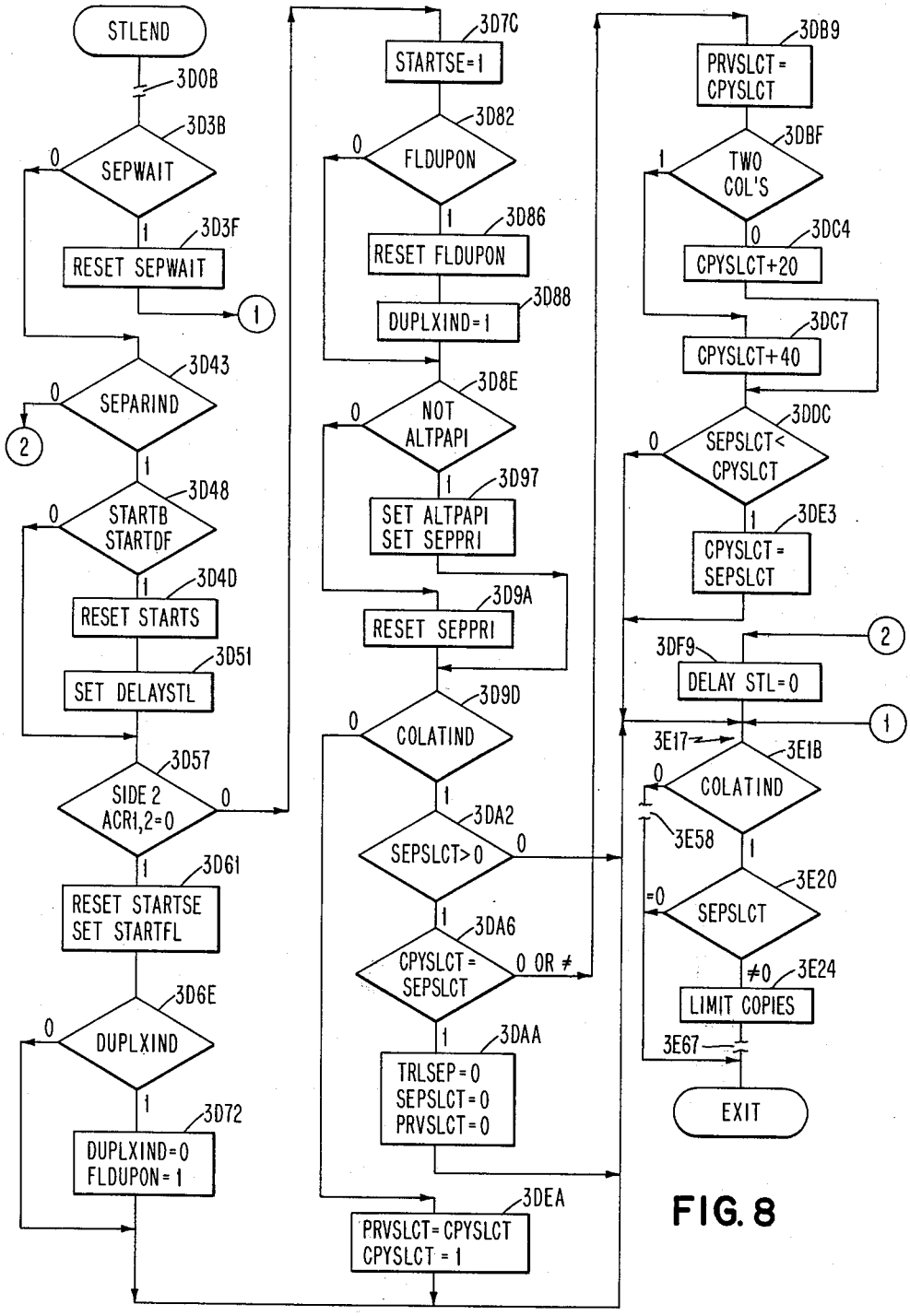
FIG. 8 is a flowchart of the STLEND process.

The flowchart of FIG. 8 shows the start-up procedure from a normal end of a prior copy production run. At location 3D0B, programming not pertinent to the function of the separation mode is executed. The SEPa-rate WAIT flag is checked by the step 3D3B. If set, it is reset by the step 3D3F. (The processor is beginning the separation mode.) The SEPWAIT flag set at this point indicates a trailing separator; that is, copies were being produced when the separate button 57 was actuated.

From the step 3D3F, the processor continues at the step 3E1B to check whether the collate mode is active.

If not, some nonpertinent code is executed at location 3E58 and the program exited. If the collate mode is active, the processor checks by the step 3E20 the number of separation sheets selected. If zero, the program is exited. If not zero, then at the step 3E24, the number of separator sheets is limited to the selection of the next succeeding copy producing run provided the selection does not exceed the output capability, i.e., forty for two collators attached to the output section 14 or twenty for a single collator. If the copy selection exceeds the output capacity, the selection of separation sheets is limited to the output capacity.

If the SEPWAIT flag is not set at the step 3D3B, the processor checks the SEPARate INDicator flag by the step 3D43. If reset, then at the step 3DF9, the processor resets the delay start latch. Because there is to be no separation mode run, copy production can begin without delay. If the SEPARIND flag is set at the step 3D43, then the processor at step 3D48 checks whether the start button is actuated or whether a run is initiated by starting the SADF 11. If so, then at the step 3D4D, all the start flags are reset and the delay start flag is set by the step 3D51.

At the step 3D57, the processor checks the SIDE 2 flag and whether any copies are in the paper path, the latter by checking the ACR 1 and 2 registers being equal to zero. (ACR is the abbreviation for automatic copy recovery and is essentially a software up/down count field for counting the transient copies in the copy path so that if ACR1 and ACR2 are equal to zero, then the paper path is clear of copy sheets.) If the SIDE 2 flag is reset and ACR1 or ACR2 is not zero, then at the step 3D7C, the separation mode start flag (STARTSE) is set.

At the step 3D82 the processor senses the FLush DUPlex light of the panel 52. At this point in the program, any flush would be completed allowing a separation run to be performed. If set, the processor resets the FLDUPON indicator by the step 3D86 and sets the DUPLeX INDicator at the step 3D88.

At the step 3D8E, the processor checks whether the alternate paper source has been selected. If not, then alternate paper is selected by the step 3D97. Also, a flag SEPPRI, indicating that copies were being made from the first paper supply in the primary paper bin 35 and not from the alternate paper bin 54, is set. At the end of the separation mode, the processor will sense SEPPRI so that upon resumption of copy production, the copy sheets will again be properly selected from first paper supply 35. If the alternate paper indicator has already been selected, then at the step 3D9A, the SEPPRI flag is reset.

At the step 3D9D, the processor checks for collator selection. If not selected, i.e., the separation mode is to run in the noncollate mode, then the copy select is set to a value of one so that one separator sheet will be supplied from the alternate paper bin supply 54 to the output tray 14A. On the other hand, if the collator indicator is active, then at the step 3DA2 the processor checks whether the separation mode selection is greater than zero. If not (SEPSLCT=0), the routine is exited by executing the step beginning with the step 3E1B as previously described. On the other hand, if the separate select value is greater than zero, then at the step 3DA6 the processor compares the number of copies selected to the number of separation sheets selected. If they are not equal (CPYSLCT≠SEPSLCT), at the step 3DB9 the previous separation value selected for the separation mode is made equal to the copy selection.

By the step 3DBF, the processor checks whether there are two collators. If not, the copy select value is increased by twenty at the step 3DC4. If there are two collators, then the copy select value is increased by forty at the step 3DC7. This increment enables the processor to display cumulative values in a copy production job that is segmented by the separation mode. The cumulative copy count indicates the progress of the job execution.

At the step 3DDC, the processor compares whether the separation mode selection value is less than the copy selection value. If not, then the step 3E1B, already described, is executed. If so, the step 3DE3 makes the copy selection value equal to the separation mode selection value. This action indicates that the last job segment has not yet been reached.

On the other hand, at the step 3DA6, if the copy select value were equal to the separation mode select value, the step 3DAA resets the trailing separator flag, clears the separate select, and resets the previous selection for the separation mode. This action indicates that the last segment of the copy job is to be performed next.

The above-described functions are set forth in detail in Table IV below.

TABLE IV

START LATCH AFTER END

| LOC | OBJ | OP1 | OP2 | SOURCE STATEMENT | |
|---|---|---|---|---|---|
| | | | | NONPERTINENT CODE | |
| | | | | 1. IF SEPWAIT | |
| 3D3B | A641 | 0041 | | LB | PSB01 |
| 3D3D | B5 | 0005 | | TR | SEPWAIT |
| 3D3E | 43 | 3D43 | | JZ | STAS01 |
| | | | | 1. THEN | |
| | | | | 2. . RESET SEPWAIT | |
| 3D3F | A141 | 0041 | | STB | PSB01 |
| 3D41 | 2CFE | 3DFE | | B | STAS02 |
| | | | | 1. ELSE | |
| | | 3D43 | STAS01 | DC | * |
| | | | | 2. . IF SEPARIND | |
| | | | | TPB | PCB06,SEPARIND |
| 3D43 | A677 | 0077 | | | |
| 3D45 | 92 | 0002 | | | |
| 3D46 | 3DF9 | 3DF9 | | BZ | STAS03 |
| | | | | 2. . THEN | |
| | | | | 3. . . IF STARTB \| STARTDF | |
| 3D48 | A656 | 0056 | | LB | PSB22 |
| | | | | TSM | P (STARTB,STARTDF) |
| 3D4A | AF28 | 0028 | | | |

TABLE IV-continued

START LATCH AFTER END

| LOC | OBJ | OP1 | OP2 | | SOURCE STATEMENT | |
|---|---|---|---|---|---|---|
| 3D4C | 47 | 3D57 | | | JZ | STAS04 |
| | | | | | 3. . . THEN | |
| | | | | | 4. . . . RESET STARTA,STARTB,STARTDF,STLREG | |
| | | | | | TRM | P(STARTA,STARTB,STARTDF,STLREQ) |
| 3D4D | AB47 | 0047 | | | | |
| 3D4F | A156 | 0056 | | | STB | PSB22 |
| | | | | | 4. . . . SET DELAYSTL | |
| | | | | | TSB | PSB03,DELAYSTL |
| 3D51 | A643 | 0043 | | | | |
| 3D53 | AF04 | 0002 | | | | |
| 3D55 | A143 | 0043 | | | | |
| | | | | | 3. . . ENDIF | |
| | | 3D57 | | STAS04 | DC | * |
| | | | | | 3. . . IF SIDE 2 &(ACR1,ACR2=0) | |
| | | | | | TPB | PSB20,DPXSIDE2 |
| 3D57 | A654 | 0054 | | | | |
| 3D59 | 95 | 0005 | | | | |
| 3D5A | 3D7C | 3D7C | | | BZ | STAS05 |
| 3D5C | 25 | | | | CLA | |
| 3D5D | A40E | 000E | | | AB | ACRREGLO |
| 3D5F | 3C7C | 3D7C | | | BNZ | STAS05 |
| | | | | | 3. . . THEN | |
| | | | | | 4. . . . RESET STARTSE, SET FLUSH,STARTFL | |
| 3D61 | A647 | 0047 | | | LB | PSB07 |
| 3D63 | B7 | 0007 | | | TR | STARTSE |
| 3D64 | AF02 | 0001 | | | TS | FLUSH |
| 3D66 | A147 | 0047 | | | STB | PSB07 |
| | | | | | TSB | PSB22,STARTFL |
| 3D68 | A656 | 0056 | | | | |
| 3D6A | AF01 | 0000 | | | | |
| 3D6C | A156 | 0056 | | | | |
| | | | | | 4. . . . IF DUPLEX LIGHT | |
| 3D6E | A676 | 0076 | | | LB | PCB05 |
| 3D70 | B2 | 0002 | | | TR | DPLXIND |
| 3D71 | 4A | 3D7A | | | JZ | STAS05L |
| | | | | | 4. . . . THEN | |
| | | | | | 5. . . . . TURN DUPLEX LIGHT OFF | |
| 3D72 | A176 | 0076 | | | STB | PCB05 |
| | | | | | 5. . . . . SET FLDUPON | |
| | | | | | TSB | PSB06,FLDUPON |
| 3D74 | A646 | 0046 | | | | |
| 3D76 | AF02 | 0001 | | | | |
| 3D78 | A146 | 0046 | | | | |
| | | | | | 4. . . . ENDIF | |
| | | | | STAS05L | EQU | * |
| 3D7A | 2CF8 | 3DF8 | | | B | STAS06 |
| | | | | | 3. . . ELSE | |
| | | 3D7C | | STAS05 | DC | * |
| | | | | | 4. . . . SET STARTSE | |
| | | | | | TSB | PSB07,STARTSE |
| 3D7C | A647 | 0047 | | | | |
| 3D7E | AF80 | 0007 | | | | |
| 3D80 | A147 | 0047 | | | | |
| | | | | | 4. . . . IF FLDUPON | |
| 3D82 | A646 | 0046 | | | LB | PSB06 |
| 3D84 | B1 | 0001 | | | TR | FLDUPON |
| 3D85 | 4E | 3D8E | | | JZ | STAS05M |
| | | | | | 4. . . . THEN | |
| | | | | | 5. . . . . RESET FLDUPON | |
| 3D86 | A146 | 0046 | | | STB | PSB06 |
| | | | | | 5. . . . . TURN ON DUPLEX LIGHT | |
| | | | | | TSB | PCB05,DPLXIND |
| 3D88 | A676 | 0076 | | | | |
| 3D8A | AF04 | 0002 | | | | |
| 3D8C | A176 | 0076 | | | | |
| | | | | | 4. . . . ENDIF | |
| | | | | STAS05M | EQU | * |
| | | | | | 4. . . . IF ¬ALTBIN LIGHT | |
| | | | | | TSB | PCB05,ALTPAPI |
| 3D8E | A676 | 0076 | | | | |
| 3D90 | AF02 | 0001 | | | | |
| 3D92 | A176 | 0076 | | | | |
| 3D94 | A645 | 0045 | | | LB | PSB05 |
| 3D96 | 6A | 3D9A | | | JNZ | STAS07 |
| | | | | | 4. . . . THEN | |
| | | | | | 5. . . . . SET ALT BIN LIGHT | |
| | | | | | 5. . . . . SET SEPPRI | |
| 3D97 | AF08 | 0003 | | | TS | SEPPRI |
| 3D99 | 0B | 3D9B | | | J | STAS08 |
| | | | | | 4. . . . ELSE | |

TABLE IV-continued

START LATCH AFTER END

| LOC | OBJ | OP1 | OP2 | | SOURCE STATEMENT | |
|---|---|---|---|---|---|---|
| | | 3D9A | | STAS07 | DC | * |
| | | | | | 5. . . . . RESET SEPPRI | |
| 3D9A | B3 | 0003 | | | TR | SEPPRI |
| | | 3D9B | | STAS08 | DC | * |
| 3D9B | A145 | 0045 | | | STB | PSB05 |
| | | | | | 4. . . . ENDIF | |
| | | | | | 4. . . . IF COLLATOR LIGHT | |
| | | | | | TPB | PCB06,COLATIND |
| 3D9D | A677 | 0077 | | | | |
| 3D9F | 91 | 0001 | | | | |
| 3DA0 | 3DEA | 3DEA | | | BZ | STX01 |
| | | | | | 4. . . . THEN | |
| | | | | | 5. . . . . IF SEPSLCT>0 | |
| 3DA2 | 25 | | | | CLA | |
| 3DA3 | D9 | 0009 | | | AR | SEPSLCT |
| 3DA4 | 3DE9 | 3DE9 | | | BZ | STX02 |
| | | | | | 5. . . . . THEN | |
| | | | | | 6. . . . . .IF CPYSLCT = SEPSLCT | |
| | | | | | SRG | INTHRG |
| 3DA6 | A9C | 00C8 | | | | |
| 3DA8 | C9 | 0009 | | | SR | CPYSLCT |
| 3DA9 | 69 | 3DB9 | | | JNZ | STX03 |
| | | | | | 6. . . . . THEN | |
| | | | | | 7. . . . . SET TRLSEP, SEPSLCT, PRVSLCT = 0 | |
| | | | | | SRG | COLRG |
| 3DAA | A9D0 | 00D0 | | | | |
| 3DAC | 8A | 000A | | | STR | PRVSLCT |
| | | | | | SRG | BASERG |
| 3DAD | A9C9 | 00C9 | | | | |
| | | | | | TSB | PSB43,TRLSEP |
| 3DAF | A66B | 006B | | | | |
| 3DB1 | AF80 | 0007 | | | | |
| 3DB3 | A16B | 006B | | | | |
| 3DB5 | 25 | | | | CLA | |
| 3DB6 | 89 | 0009 | | | STR | SEPSLCT |
| 3DB7 | 2CE9 | 3DE9 | | | B | STX06 |
| | | | | | 6. . . . . ELSE | |
| | | | | STX03 | EQU | * |
| | | | | | 7. . . . . PRVSLCT = CPYSLCT | |
| 3DB9 | B9 | 0009 | | | LR | CPYSLCT |
| | | | | | SRG | COLRG |
| 3DBA | A9D0 | 00D0 | | | | |
| 3DBC | 8A | 000A | | | STR | PRVSLCT |
| | | | | | SRG | INTHRG |
| 3DBD | A9C8 | 00C8 | | | | |
| | | | | | 7. . . . . IF ¬MD2PRES | |
| | | | | | RIN | CSB14 |
| 3DBF | A6D5 | 00D5 | | | | |
| 3DC1 | 96 | 0006 | | | TP | MD2PRES |
| 3DC2 | 25 | | | | CLA | |
| 3DC3 | 67 | 3DC7 | | | JNZ | STXC2 |
| | | | | | 7. . . . . THEN | |
| | | | | | 8. . . . . CPYSLCT=CPYSLCT+ 20 | |
| 3DC4 | AE20 | 0020 | | | LI | X'20' |
| 3DC6 | 09 | 3DC9 | | | J | STXC3 |
| | | | | | 7. . . . . ELSE | |
| | | 3DC7 | | STXC2 | DC | * |
| | | | | | 8. . . . . CPYSLCT=CPYSLCT+ 40 | |
| 3DC7 | AE40 | 0040 | | | LI | X'40' |
| | | | | | 7. . . . . ENDIF | |
| 3DC9 | D9 | 0009 | | STXC3 | AR | CPYSLCT |
| 3DCA | 89 | 0009 | | | STR | CPYSLCT |
| 3DCB | 25 | | | | CLA | |
| 3DCC | A609 | 0009 | | | LB | CPYSLLO |
| 3DCE | ABF0 | 00F0 | | | NI | X'F0' |
| 3DD0 | AAA0 | 00A0 | | | SI | X'A0' |
| | | | | | JL | STXC4 |
| 3DD2 | 3FD5 | 3DD5 | | | | |
| 3DD4 | 0C | 3DDC | | | | |
| 3DD5 | A109 | 0009 | | | STB | CPYSLLO |
| 3DD7 | A619 | 0019 | | | LB | CPYSLHI |
| 3DD9 | 2E | | | | A1 | |
| 3DDA | A119 | 0019 | | | STB | CPYSLHI |
| | | 3DDC | | STXC4 | DC | * |
| | | | | | 7. . . . . IF SEPSLCT<CPYSLCT | |
| 3DDC | E9 | 0009 | | | LR | CPYSLCT |
| | | | | | SRG | BASERG |
| 3DDD | A9C9 | 00C9 | | | | |
| 3DDF | C9 | 0009 | | | SR | SEPSLCT |
| | | | | | JL | STXC7 |

TABLE IV-continued

START LATCH AFTER END

| LOC | OBJ | OP1 | OP2 | | SOURCE STATEMENT |
|---|---|---|---|---|---|
| 3DE0 | 3FE3 | 3DE3 | | | |
| 3DE2 | 09 | 3DE9 | | | |
| | | | | | 7. . . . . THEN |
| | | | | | 8. . . . . .CPYSLCT=SEPSLCT |
| 3DE3 | E9 | 0009 | | | LR SEPSLCT |
| 3DE4 | A109 | 0009 | | | STB CPYSLLO |
| 3DE6 | 29 | | | | TRA |
| 3DE7 | A119 | 0019 | | | STB CPYSLHI |
| | | | | | 7. . . . . ENDIF |
| | | | | STXC7 | EQU * |
| | | | | | 6. . . . . ENDIF |
| | | | | STX06 | EQU * |
| | | | | | 5. . . . . ENDIF |
| 3DE9 | 08 | 3DF8 | | STX02 | J STX05 |
| | | | | | 4. . . . ELSE |
| | | | | STX04 | EQU * |
| | | | | | 5. . . . . PRVSLCT=CPYSLCT |
| | | | | | SRG INTHRG |
| 3DEA | A9C8 | 00C8 | | | |
| 3DEC | E9 | 0009 | | | LR CPYSLCT |
| | | | | | SRG COLRG |
| 3DED | A9D0 | 00D0 | | | |
| 3DEF | 8A | 000A | | | STR PRVSLCT |
| | | | | | SRG BASERG |
| 3DF0 | A9C9 | 00C9 | | | |
| | | | | | 5. . . . . CPYSLCT=1 |
| 3DF2 | 25 | | | | CLA |
| 3DF3 | A119 | 0019 | | | STB CPYSLHI |
| 3DF5 | 2E | | | | A1 |
| 3DF6 | A109 | 0009 | | | STB CPYSLLO |
| | | | | | 4. . . . ENDIF |
| | | | | STX05 | EQU * |
| | | | | | 3. . . ENDIF |
| | | 3DF8 | | STAS06 | DC * |
| 3DF8 | 0E | 3DFE | | | J STAS09 |
| | | | | | 2. . ELSE |
| | | 3DF9 | | STAS0 | DC * |
| | | | | | 3. . . RESET DELAYSTL |
| | | | | | TRB PSB03, DELAYSTL |
| 3DF9 | A643 | 0043 | | | |
| 3DFB | B2 | 0002 | | | |
| 3DFC | A143 | 0043 | | | |
| | | | | | 2. . ENDIF |
| | | 3DFE | | STAS09 | DC * |
| | | | | | 1. ENDIF |
| | | | | | NONPERTINENT CODE |
| | | | | | 2. . IF COLLATE LIGHT |
| | | | | | TPB PCB06,COLATIND |
| 3E1B | A677 | 0077 | | | |
| 3E1D | 91 | 0001 | | | |
| 3E1E | 3D58 | 3E58 | | | BZ STARXX4 |
| | | | | | 2. . THEN |
| | | | | | 3. . . IF SEPSLCT=0 |
| 3E20 | 25 | | | | CLA |
| 3E21 | D9 | 0009 | | | AR SEPSLCT |
| 3E22 | 3C50 | 3E50 | | | BNZ STARM01 |
| | | | | | 3. . . THEN |
| | | | | | 4. . . . IF CPYSLCT > 20 (40 IF MOD 2 PRESENT) |
| 3E24 | 25 | | | | CLA |
| | | | | | RIN CSB14 |
| 3E25 | A6D5 | 00D5 | | | |
| 3E27 | 96 | 0006 | | | TP MD2PRES |
| 3E28 | AE20 | 0020 | | | LI X'20' |
| 3E2A | 4D | 3E2D | | | JZ STARM02 |
| 3E2B | AE40 | 0040 | | | LI X'40' |
| | | | | STARM02 | SRG INTHRG |
| 3E2D | A9C8 | 00C8 | | | |
| 3E2F | C9 | 0009 | | | SR CPYSLCT |
| 3E30 | E9 | 0009 | | | LR CPYSLCT |
| | | | | | SRG BASERG |
| 3E31 | A9C9 | 00C9 | | | |
| 3E33 | 3F37 | 3E37 | | | BNL STARM03 |
| | | | | | 4. . . . THEN |
| | | | | | 5. . . . . SEPSLCT = CPYSLCT |
| 3E35 | 89 | 0009 | | | STR SEPSLCT |
| 3E36 | 0C | 3E3C | | | J STARM05 |
| | | | | | 4. . . . ELSE |
| | | | | STARM03 | EQU * |
| | | | | | 5. . . . . PRVSLCT = CPYSLCT |
| | | | | | SRG COLRG |

TABLE IV-continued

START LATCH AFTER END

| LOC | OBJ | OP1 | OP2 | | SOURCE STATEMENT | |
|---|---|---|---|---|---|---|
| 3E37 | A9D0 | 00D0 | | | | |
| 3E39 | 8A | 000A | | | STR | PRVSLCT |
| | | | | | SRG | BASERG |
| 3E3A | A9C9 | 00C9 | | | | |
| | | | | | 4. . . . ENDIF | |
| | | | | STARM05 | EQU | * |
| | | | | | 4. . . . LIMIT SELECTION TO 40 OR 20 (MOD2 PRESENT OR NOT PRESENT) | |
| 3E3C | 25 | | | | CLA | |
| | | | | | RIN | CSB14 |
| 3E3D | A6D5 | 00D5 | | | | |
| 3E3F | 96 | 0006 | | | TP | MD2PRES |
| 3E40 | AE40 | 0040 | | | LI | X'40' |
| 3E42 | 65 | 3E45 | | | JNZ | STARC02 |
| 3E43 | AE20 | 0020 | | | LI | X'20' |
| 3E45 | 80 | 0000 | | STARC02 | STR | R0 |
| | | | | | SRG | INTHRG |
| 3E46 | A9C8 | 00C8 | | | | |
| 3E48 | C9 | 0009 | | | SR | CPYSLCT |
| 3E49 | 3F4F | 3E4F | | | BNL | STARM04 |
| 3E4B | 25 | | | | CLA | |
| 3E4C | A620 | 0120 | | | LBL | BASEROLD |
| 3E4E | 89 | 0009 | | | STR | CPYSLCT |
| 3E4F | 06 | 3E56 | | STARM04 | J | STARM10 |
| | | | | | 3. . . ELSE | |
| | | | | STARM01 | EQU | * |
| | | | | | 4. . . . CPYCTR = PRVSLCT | |
| | | | | | SRG | COLRG |
| 3E50 | A9D0 | 00D0 | | | | |
| 3E52 | EA | 000A | | | LR | PRVSLCT |
| | | | | | SRG | INTHRG |
| 3E53 | A9C8 | 00C8 | | | | |
| 3E55 | 87 | 0007 | | | STR | CPYCTR |
| | | | | | 3. . . ENDIF | |
| 3E56 | 2C67 | 3E67 | | STARM10 | B | STARC03 |
| | | | | | 2. . ELSE | |
| | | | | STARXX4 | EQU | * |
| | | | | | 3. . . IF DUPLEX | |
| | | | | | TPB | PCB05,DPLXIND |
| 3E58 | A676 | 0076 | | | | |
| 3E5A | 92 | 0002 | | | | |
| 3E5B | 47 | 3E67 | | | JZ | STARXX1 |
| | | | | | 3. . . THEN | |
| | | | | | 4. . . . LIMIT COPY SELECT TO 100 | |
| 3E5C | AE01 | 0001 | | | LI | 1 |
| 3E5E | A019 | 0019 | | | CB | CPYSLHI |
| 3E60 | 3E67 | 3E67 | | | BH | STARXX1 |
| 3E62 | A119 | 0019 | | | STB | CPYSLHI |
| 3E64 | 25 | | | | CLA | |
| 3E65 | A109 | 0009 | | | STB | CPYSLLO |
| | | | | | 3. . . ENDIF | |
| | | | | STARXX1 | EQU | * |
| | | | | | 2. . ENDIF | |
| | | | | STARC03 | SRG | BASERG |
| 3E67 | A9C9 | 00C9 | | | | |
| 3E69 | A647 | 0047 | | | | |

NONPERTINENT CODE

Figure 9:
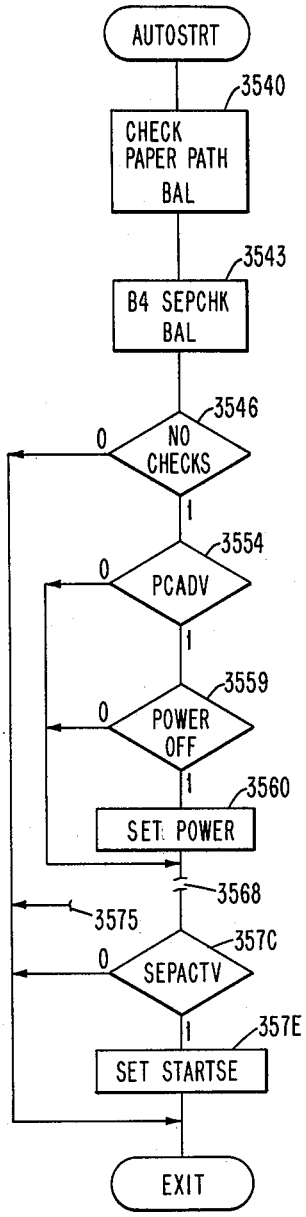
FIG. 9 is a flowchart of the AUTOSTRT process.

A start from an interruption, such as a copy sheet jam, is achieved by the AUTOSTART program shown in FIG. 9. The first step in this program is to call a subroutine to check the paper path via a branch and link (BAL) instruction at location 3540. The subroutine for checking the paper path need not be shown for an understanding of the invention. It scans all of the sensing switches in the paper path of the copy production machine 10 to ensure that all the paper has been removed. Then a second branch and link at 3543 calls the B4 SEPCHK subroutine previously described. Upon return from the BASEPCHK subroutine, the processor by the step 3546 determines whether there are any outstanding machine errors, such as check paper path, check collator, and the like. If there are none, the routine can be exited for entering SET STARTL of FIG. 7. If there are checks, the computer must then determine why copy production cannot resume. First, the computer checks by step 3554 whether a photoconductor (PC) advance was interrupted. A photoconductor advance is an auxiliary operation moving new photoconductor into an imaging location such as shown in U.S. Pat. No. 3,588,242. If there was a PC advance, then at the step 3559 the processor checks whether a secondary power relay (not shown) is off or on. The secondary power relay provides power to the fuser 31 inter alia. If it is off, a power indicator flag is set by the step 3560 to enable the processor to restore power by another program (not shown). Next, some nonpertinent code beginning a location 3568 is executed. At step 357C, the SEPACTV flag is checked. If set when the abnormal end or interruption occurred, then the separation mode is restarted by setting the STARTSE flag at 357E. Other programs to be described sense for STARTSE for initiating the separation mode.

Techniques for ensuring that the correct number of separation sheets are to be transferred through the output section 14 is not a part of the present invention and will, therefore, not be described. Because of the varying effects of starting from an abnormal end or interruption, most of the code in the illustrated program is nonpertinent to the separation mode. The nonpertinent code is indicated by the arrow 3575.

After the start latch has been set, the asynchronous program illustrated in FIG. 10 that controls the SADF 11 checks for SEPWAIT in the inhibits checked in a subroutine called by a branch and link instruction at location 488C. The inhibits, in addition to SEPWAIT, include open doors of copy production machine 10, a flush occurring, copy recovery in progress, and the like. If SEPWAIT is reset (no inhibit), a branch instruction executed at location 488F causes nonpertinent SADF code to be executed beginning either at location 48DD or, if SEPWAIT is set, nonpertinent SADF code beginning at 490D is executed. This illustrates the close interaction of all the computer programs illustrated for executing the separation mode and the effect of status registers 263 in providing communications between asynchronous programs and synchronous programs 262. Table V below lists the STLEND program details and Table VI, the SADF program details.

TABLE V

AUTOSTART

| LOC | OBJ | OP1 | OP2 | SOURCE STATEMENT | | |
|---|---|---|---|---|---|---|
| | | | | BEGIN AUTOSTRT ATTEMPT AN AUTO RESTART WHEN DOORS GO CLOSED | | |
| | | 3540 | | ORG | AUTORG | |
| | | | | 1. CALL PATHCHK GO CHECK PAPER PATH | | |
| 3540 | 32384D | 0002 | 4D38 | BAL | R2,PATHCHK GO CHECK PAPER PATH | |
| | | | | 1. CALL B4SEPCHK GO CHECK B4 SEPARATION | | |
| 3543 | 33F854 | 0003 | 54F8 | BAL | R3,B4SEPCHK | |
| | | | | 1. IF ¬CPP & ¬CHKCOL | | |
| 3546 | 25 | | | CLA | | |
| 3547 | A45D | 005D | | AB | CPP | |
| 3549 | 3C82 | 3582 | | BNZ | MAC057 | |
| 354B | A44D | 004D | | AB | CPPE1 | |
| 354D | 3C82 | 3582 | | BNZ | MAC057 | |
| | | | | TPB | PCB14,CKCOLTRI | |
| 354F | A67E | 007E | | | | |
| 3551 | 90 | 0000 | | | | |
| 3552 | 3C82 | 3582 | | BNZ | MAC057 | |
| | | | | 1. THEN | | |
| | | | | 2. . IF (PCADVNCE) ADVANCE WAS INTERRUPTED | | |
| | | | | TPB | PCB02,PCADVNCE SEE IF ADVANCE | |
| 3554 | A673 | 0073 | | | | |
| 3556 | 90 | 0000 | | | | |
| 3557 | 3D68 | 3568 | | BZ | MAC053 | * GO IF NO |
| | | | | 2. . THEN | | |
| | | | | 3. . . IF (¬RELAY2) SECONDARY RELAY IS OFF | | |
| 3559 | A9A0 | 00A0 | | GI | INTOFF | MASK |
| 355B | A67C | 007C | | LB | PCB12 | GET STATUS |
| 355D | AF40 | 0006 | | TS | RELAY2 | SET RELAY2 |
| 355F | 66 | 3566 | | JNZ | MAC052 | * GO IF ALREADY ON |
| | | | | 3. . . THEN | | |
| | | | | 4. . . . OUTPUT RELAY2=1 | | |
| 3560 | A17C | 007C | | STB | ¬ PCB12 | START RELAY |
| | | | | 4. . . . SET MTRDLY=16 (130 MSEC) | | |
| 3562 | AE10 | 0010 | | LI | 16 | SET DELAY |
| 3564 | A159 | 0059 | | STB | MTRDLY | START TIMER |
| | | | | 3. . . ENDIF | | |
| | | 3566 | MAC052 | DC | * | |
| 3566 | A920 | 0020 | | GI | INTON | UNMASK |
| | | | | 2. . ENDIF | | |
| | | | | NONPERTINENT CODE | | |

TABLE VI

SADF CODE

| LOC | OBJ | OP1 | OP2 | SOURCE STATEMENT |
|---|---|---|---|---|
| | | | | NONPERTINENT CODE |
| | | | | 4. . . . CALL CHKINH |
| | | | | BAL R1,CHKORG |
| | | | | 4. . . . IF ¬ (ANY INHIBITS FOUND ABOVE) & ¬ (ACRREQ & (BACKUP>1 \| (BACKUP=1 & AUTOFLSH))) & INTLOCK & ¬ INDF & ¬ INHFD1 & ¬ INHFD2 & ¬INHFD3 & ¬COLL_DOORS_OPEN & PSBIND & ¬SADFBUSY & (¬ADDPAPER \| CPYINDPI) & (¬SEPIND \| SEPWAIT \| ¬DRIVE) & ¬FLUSH & (¬SEPACTV \| DRIVE) |
| 488F | 340C | 490C | | BNZ SADF27 |
| | | | | TPB PSB01,ACRREQ |
| 4891 | A641 | 0041 | | |
| 4893 | 91 | 0001 | | |
| 4894 | 41 | 48A1 | | JZ SADF19B |
| 4895 | A66C | 006C | | LB BACKUP |
| 4897 | A801 | 0001 | | CI 1 |
| 4899 | 360C | 490C | | BH SADF27 |
| 489B | 61 | 48A1 | | JNE SADF19B |
| | | | | TPB PSB01,AUTOFLSH |

TABLE VI-continued

SADF CODE

| LOC | OBJ | OP1 | OP2 | SOURCE STATEMENT | | | |
|---|---|---|---|---|---|---|---|
| 489C | A641 | 0041 | | | | | |
| 489E | 92 | 0002 | | | | | |
| 489F | 340C | 490C | | | BNZ | SADF27 | |
| | | 48A1 | | SADF19B | DC | * | |
| | | | | | RIN | CSB03 | GET STATUS |
| 48A1 | A6C2 | 00C2 | | | | | |
| 48A3 | 97 | 0007 | | | TP | INTLOCK | TEST FOR PLUGGABLE METER |
| 48A4 | 350C | 490C | | | BZ | SADF27 | *GO IF NO |
| 48A6 | A65F | 005F | | | LB | PSB31 | |
| 48A8 | ABF8 | 00F8 | | | NI | P1(INDF,INHFD1,INHFD2,SADFBUSY,INHFD3) | |
| 48AA | 340C | 490C | | | BNZ | SADF27 | |
| | | | | | SRG | COLRG | |
| 48AC | A9D0 | 00D0 | | | | | |
| 48AE | A607 | 0007 | | | LB | CPSB02 | |
| | | | | | SRG | BASERG | |
| 48B0 | A9C9 | 00C9 | | | | | |
| | | | | | TSM | P(COLDR12,COLDR22) | |
| 48B2 | AF50 | 0050 | | | | | |
| 48B4 | 340C | 490C | | | BNZ | SADF27 | |
| | | | | | TPB | PCB13,PLSSTBY | |
| 48B6 | A67D | 007D | | | | | |
| 48B8 | 96 | 0006 | | | | | |
| 48B9 | 340C | 490C | | | BNZ | SADF27 | |
| | | | | | TPB | PSB07,ADDPAPER | |
| 48BB | A647 | 0047 | | | | | |
| 48BD | 94 | 0004 | | | | | |
| 48BE | 44 | 48C4 | | | JZ | SADF24A | |
| | | | | | TPB | PCB13,CYINDPI | |
| 48BF | A67D | 007D | | | | | |
| 48C1 | 93 | 0003 | | | | | |
| 48C2 | 350C | 490C | | | BZ | SADF27 | |
| | | 48C4 | | SADF24A | DC | * | |
| | | | | | TPB | PCB06,SEPARIND | |
| 48C4 | A677 | 0077 | | | | | |
| 48C6 | 92 | 0002 | | | | | |
| 48C7 | 41 | 48D1 | | | JZ | SADF24B | *GO IF NOT SEPARATE INDICATOR |
| | | | | | TPB | PSB01,SEPWAIT | |
| 48C8 | A641 | 0041 | | | | | |
| 48CA | 95 | 0005 | | | | | |
| 48CB | 61 | 48D1 | | | JNZ | SADF24B | *GO IF YES |
| | | | | | TPB | PSB21,DRIVE | |
| 48CC | A655 | 0055 | | | | | |
| 48CE | 90 | 0000 | | | | | |
| 48DF | 340C | 490C | | | BNZ | SADF27 | *GO-CONDITIONS WERE NOT FAVORABLE |
| | | | | SADF24B | EQU | * | |
| | | | | | TPB | PSB07,FLUSH | |
| 48D1 | A647 | 0047 | | | | | |
| 48D3 | 91 | 0001 | | | | | |
| 48D4 | 340C | 490C | | | BNZ | SADF27 | |
| 48D6 | 93 | 0003 | | | TP | SEPACTV | |
| 48D7 | 4D | 48DD | | | JZ | SADF24C | |
| | | | | | TPB | PSB21,DRIVE | |
| 48D8 | A655 | 0055 | | | | | |
| 48DA | 90 | 0000 | | | | | |
| 48DB | 350C | 490C | | | BZ | SADF27 | |
| | | | | | 4. . . . THEN | | |
| | | | | | NONPERTINENT CODE | | |
| | | | | | (LOCATION 48DD) | | |
| | | | | | 5. . . . . ELSE | | |
| | | | | | NONPERTINENT CODE | | |
| | | | | | (LOCATION 490C) | | |

The above-described programs illustrate the preparatory steps in the asynchronous programs necessary for starting a separation mode. Up to this point, the asynchronous programs have actually been executed several times. As conditions changed during separation mode preparation, different branches of the programs were correspondingly executed.

If a flush of the interim storage unit 40 is required, any separation mode run must wait until the interim storage unit 40 is empty. When the start button has been pushed, sensed, and honored, the photoconductor drum 20 rotates supplying EC and synchronization pulses from the emitter wheel 46. These pulses are detected by interrupting the asynchronous programs so that the synchronous programs are executed in synchronization with the rotation of the photoconductor drum 20. For each rotation of photoconductor drum 20, each of the synchronous programs 262 will be executed twice. As a result of those repetitive executions, the copy production machine 10 is synchronously operated while being simultaneously asynchronously monitored and controlled by the asynchronous programs 260, 261.

By virtue of the interrupt procedure, the synchronous programs 262 have priority over the asynchronous programs except when the interrupts are masked. When an EC pulse is received from the emitter wheel 46, the respective synchronous program must be executed immediately to ensure proper operation of the copy production machine 10. The control exercised by the processor via the synchronous programs 262 is based upon a machine state field CR contained in status registers 263 and the timing pulses ECO–EC16 supplied by the emitter wheel 46. In a constructed embodiment of the invention, the CR field contains eight bits, CR1 to CR8, plus some other bits not pertinent to understanding the operation of the synchronous program 262. Generally, the bit positions correspond to general functions of the copy production machine 10 with respect to the travel of copy sheets through the machine. Other functions may be performed in accordance with the bit pattern which, however, is not important for an understanding of the invention. In general, CR1 indicates that a copy sheet should be picked from the selected source. Machine functions indicated by bit CR2 are primarily preparatory steps for image transfer from the photoconductor drum 20 to the copy sheet. Included in the preparatory steps are lamp control, magnetic brush checking, SADF 11 control, and the like. The bit positions CR3 and CR4 are primarily related to image transfer controls such as fuser opening and closing, early exit arrivals, detach of copy sheets from the photoconductor drum 20 and the like. The CR5 bit indicates certain post-image-transfer housekeeping chores. The bits CR6, CR7, and CR8 are primarily related to collator controls. The processor is programmed to maintain machine status with respect to each copy sheet being transferred through the machine by inserting a binary one in the respective bit positions such that the associated machine functions can be appropriately performed. The meshing of the timing pulses EC0–EC16 with the CR fields follows the same timing control techniques used by prior relay control machines such as the IBM Copier II manufactured by the International Business Machines Corporation, Armonk, New York.

The ECO program (FIG. 11) performs some of the preparatory steps necessary for beginning an image cycle. Many functions are performed during this particular synchronous program including nonpertinent code represented at location 6DE9. Because of the extremely high speed program execution, the order of execution of synchronous programs 262 in some instances can be somewhat independent of the order in which the machine actually functions and are executed several times for many individual functions of the machine 10. For clarity and to avoid describing the program repetitions, the description will follow program execution rather than machine functions.

At the step 6E25, the processor checks whether the CR2 bit is set. If reset, no pertinent action is taken and the program is exited via the nonpertinent code at the step 6EBC. If set, certain pertinent preparatory steps are performed. Execution of this program assumes that a copy sheet has already been picked. After sensing CR2 set, the processor determines whether preconditioning is occurring at the step 6E29. The term "preconditioning" is defined in copending, commonly assinged patent application Ser. No. 649,755, filed Jan. 15, 1976 and now U.S. Pat. No. 4,036,556. If preconditioning is occurring, then no copy sheets will be transported and the ECO code is exited via the nonpertinent code at step 6EBC. Otherwise, the processor by the step 6E2E increments the value in the Copy-CounTeR-SAVE counter to be one greater than the value of the copy counter. At the step 6E3F, the processor checks whether there is a stop or error condition. If there is, the program is exited via the nonpertinent code at step 6EBC. If, one the other hand, the condition of the machine 10 is error-free, then the processor at step 6E53 checks whether the SIDE 2 flag is set. If set, then the processor checks by the step 6E58 whether the ISU 40 is not empty. If the ISU 40 has copies in it, then the processor at step 6E5D checks whether the separation mode is set and whether the copy select value (CNT) is greater than the collator capacity (COL). If both conditions are true, then the collator overflow flag is set by the step 6E7A so that the copies being produced will be produced from the duplex tray and the copies in excess of the collator capacity will be exited to the copy output tray 14A. On the other hand, if either condition of the branch step 6E5D is not true, then the CR1 bit is set at step 6E7F in preparation for picking a copy sheet from the designated paper supply. If the ISU 40 is empty at the step 6E58, then the END flag is set by the step 6E89. Nonpertinent code at location 6E98 is executed before performing the step 6EA9 for detecting whether the copy-counter save value is less than the copy select value. If less, then copies are yet to be produced and CR1 is set at the top step 6EAD. On the other hand, if the counter save value is not less than the copy select value, the run is over and the END flag is set at step 6EB2. The program is exited via the nonpertinent code beginning with the step 6EBC.

The program details for the above flowchart are set forth below in Table VII.

TABLE VII

EC0 CODE

| LOC | OBJ | OP1 | OP2 | SOURCE STATEMENT | | |
|---|---|---|---|---|---|---|
| | | | | NONPERTINENT CODE | | |
| | | | | 2. . IF CR2 | | |
| 6E25 | E4 | 0004 | | LR | CRREG | CR REGISTERS' REGISTER |
| 6E26 | 96 | 0006 | | TP | CR2 | TEST IF CR2 IS ACTIVE |
| 6E27 | 3DB8 | 6EB8 | | BZ | EC0E | IF CR2 NOT ACTIVE BRANCH TO CR6 TEST |
| | | | | 2. . THEN | | |
| | | | | 3. . . IF ¬PRECOND | | |
| | | | | TPB | PSB07,PRECOND | |
| 6E29 | A647 | 0047 | | | | |
| 6E2B | 90 | 0000 | | | | |
| 6E2C | 3CB8 | 6EB8 | | BNZ | EC0E | |
| | | | | 3. . . THEN | | |
| | | | | 4. . . . CCTRSAVE=CPYCTR+1 | | |
| 6E2E | E7 | 0007 | | LR | CPYCTR | |
| 6E2F | 2E | | | A1 | | |
| 6E30 | 85 | 0005 | | STR | CCTRSAVE | |
| 6E31 | AB0F | 000F | | NI | X'0F' | |
| 6E33 | AB0A | 000A | | CI | 10 | |

TABLE VII-continued

EC0 CODE

| LOC | OBJ | OP1 | OP2 | SOURCE STATEMENT |
|---|---|---|---|---|
| 6E35 | 6F | 6E3F | | JNE EC0D3A1 |
| 6E36 | E5 | 0005 | | LR CCTRSAVE |
| 6E37 | AC06 | 0006 | | AI 6 |
| 6E39 | A A0 | 00A0 | | CI X'A0' |
| 6E3B | 6E | 6E3E | | JNE EC0D3A |
| 6E3C | AC60 | 0060 | | AI X'60' |
| | | 6E3E | EC0D3A | DC * |
| 6E3E | 85 | 0005 | | STR CCTRSAVE |
| | | 6E3F | EC0D3A1 | DC * |
| | | | | 4. . . . IF ¬STOP2 & ¬TNRFAIL & ¬TNRCPP & ¬COLSTOP |
| | | | | TPB PSB23,STOP2 |
| 6E3F | A657 | 0057 | | |
| 6E41 | 91 | 0001 | | |
| 6E42 | 3CB8 | 6EB8 | | BNZ EC0E |
| 6E44 | A65D | 005D | | LB CPP |
| | | | | TSM P(TNRFAIL,TNRCPP) |
| 6E46 | AF82 | 0082 | | |
| 6E48 | 3CB8 | 6EB8 | | BNZ EC0E |
| | | | | SRG COLRG |
| 6E4A | A9D0 | 00D0 | | |
| | | | | TPB CPSB08,COLSTOP |
| 6E4C | A619 | 0019 | | |
| 6E4E | 97 | 0007 | | |
| | | | | SRG INTHRG |
| 6E4F | A9C8 | 00C8 | | |
| 6E51 | 3CB8 | 6EB8 | | BNZ EC0E |
| | | | | 4. . . . THEN |
| | | | | 5. . . . . IF SIDE_2 ACTIVE |
| | | | | TPB PS20,DPXSIDE2 |
| 6E53 | A654 | 0054 | | |
| 6E55 | 95 | 0005 | | |
| 6E56 | 3DA9 | 6EA9 | | BZ EC0D3 |
| | | | | 5. . . . . THEN |
| | | 6E58 | EC0D | DC * |
| | | | | 6. . . . . IF COPIES IN DUPLEX |
| | | | | RIN CSB06 |
| 6E58 | A6C5 | 00C5 | | |
| 6E5A | 92 | 0002 | | TP CPYINDP |
| 6E5B | 3D89 | 6E89 | | BZ EC0D1 |
| | | | | 6. . . . . THEN |
| | | | | 7. . . . . IF COLLATE IND & (CCTRSAVE >19 −39 IF MOD2 PRESENT) & SEPSLCT=0 & ¬COLOFLO |
| | | | | TPB PCB06,COLATIND |
| 6E5D | A675 | 0075 | | |
| 6E5F | 91 | 0001 | | |
| 6E60 | 3D7F | 6E7F | | BZ EC0W01 |
| 6E62 | 25 | | | CLA |
| | | | | RIN CSB14 |
| 6E63 | A6D5 | 00D5 | | |
| 6E65 | 96 | 0006 | | TP MD2PRES |
| 6E66 | AE19 | 0019 | | LI X'19' 19 COPIES |
| 6E68 | 4B | 6E6B | | JZ EC0W02 |
| 6E69 | AE39 | 0039 | | LI X'39' 39 COPIES |
| 6E6B | C5 | 0005 | EC0W02 | SR CCTRSAVE |
| 6E6C | 3F7F | 6E7F | | BNL EC0W01 |
| | | | | SRG BASERG |
| 6E6E | A9C9 | 00C9 | | |
| 6E70 | 25 | | | CLA |
| 6E71 | D9 | 0009 | | AR SEPSLCT |
| 6E72 | 3C7F | 6E7F | | BNZ EC0W01 |
| | | | | SRG COLRG |
| 6E74 | A9D0 | 00D0 | | |
| | | | | TPB CPSB04,COLOFLO |
| 6E76 | A609 | 0009 | | |
| 6E78 | 95 | 0005 | | |
| 6E79 | 6F | 6E7F | | JNZ EC0W01 |
| | | | | 7. . . . . THEN |
| | | | | 8. . . . . SET COLOFLOR |
| 6E7A | AF40 | 0006 | | TS COLOFLOR |
| 6E7C | A109 | 0009 | | STB CPSB04 |
| 6E7E | 05 | 6E85 | | J EC0W03 |
| | | | | 7. . . . . ELSE |
| | | | EC0W01 | EQU * |
| | | | | 8. . . . . SET CR1 |
| | | | | SRG INTHRG |
| 6E7F | A9C8 | 00C8 | | |
| 6E81 | E4 | 0004 | | LR CRREG |
| 6E82 | AF80 | 0007 | | TS CR1 |
| 6E84 | 84 | 0004 | | STR CRREG |
| | | | | 7. . . . . ENDIF |

TABLE VII-continued

EC0 CODE

| LOC | OBJ | OP1 | OP2 | SOURCE STATEMENT |
|---|---|---|---|---|
| | | | EC0W03 | SRG INTHRG |
| 6E85 | A9C8 | 00C8 | | |
| 6E87 | 2CA8 | 6EA8 | | B EC0D2 |
| | | | | 6. . . . . ELSE |
| | | 6E89 | EC0D1 | DC * |
| | | | | 7. . . . . SET END=1 |
| | | | | TSB PSB03,END |
| 6E89 | A643 | 0043 | | |
| 6E8B | AF80 | 0007 | | |
| 6E8D | A143 | 0043 | | |
| | | | | NONPERTINENT CODE |
| | | | | 6. . . . . IF CCTRSAVE LESS THAN CPYSLCT |
| 6EA9 | E5 | 0005 | | LR CCTRSAVE |
| 6EAA | C9 | 0009 | | SR CPYSLCT |
| 6EAB | 3FB2 | 6EB2 | | BNL EC0D4 |
| | | | | 6. . . . . THEN |
| | | | | 7. . . . . SET CR1=1 |
| 6EAD | E4 | 0004 | | LR CRREG |
| 6EAE | AF80 | 0007 | | TS CR1 |
| 6EB0 | 84 | 0004 | | STR CRREG |
| 6EB1 | 08 | 6EB8 | | J ECOE |
| | | | | 6. . . . . ELSE |
| | | 6EB2 | EC0D4 | DC * |
| | | | | 7. . . . . SET END=1 |
| | | | | TSB PSB03,END |
| 6EB2 | A643 | 0043 | | |
| 6EB4 | AF80 | 0007 | | |
| 6EB6 | A143 | 0043 | | |
| | | | | 6. . . . . ENDIF |
| | | | | 5. . . . . ENDIF |
| | | | | 4. . . . ENDIF |
| | | | | 3. . . ENDIF |
| | | | | 2. . ENDIF |
| | | | | NONPERTINENT CODE |

Figure 20:
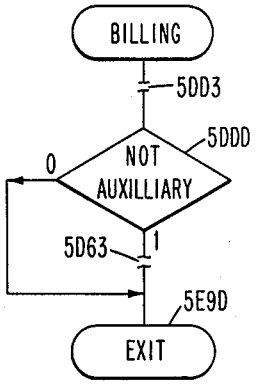
FIG. 20 is a flowchart showing pertinent parts of the BILLING process.

In FIG. 20, the ECOCR1 program is shown. In the sequence of machine preparation for copy production, EC0-CR1 code has an effect before the ECO code of FIG. 11. In EC0-CR1, the processor checks by the step 7006 whether there are no-paper modes, i.e., the machine operation will not require transport of copy sheets from any of the paper supplies. If it is a no-paper mode, there is no need to pick paper so the entire program is bypassed. If, on the other hand, a paper mode is indicated, the processor checks the CR1 bit at the step 7011. If the CR1 field bit is not set, it is not time to pick paper so the remaining code is bypassed. If CR1 is set, then the truck flags are reset at the step 7015. The trucks are the mechanisms in the copy production machine 10 which reach into the paper supply bins to remove a copy sheet for copy production or for separation sheets. Such devices are shown in the IBM TECHNICAL DISCLOSURE BULLETIN, February 1974 on pages 2966 and 2967. With the trucks being reset to an out-of-supply bin, a no-pick position, the processor can select from which of the supplies to pick a copy sheet.

At the step 701A, the processor checks the separate standby (SEPSTBY) flag. If it is set, the separation mode is being performed so the alternate truck for the supply 54 is selected by the step 701E. Nonpertinent code is executed beginning at location 7028 and this synchronous program is exited to other ECO codes (not shown) which are not pertinent to the present invention.

TABLE VIII

EC0 CR1 CODE

| LOC | OBJ | OP1 | OP2 | SOURCE STATEMENT |
|---|---|---|---|---|
| | | | | BEGIN EC0CR1 |
| | | | | 1. IF ¬PRECOND &¬CENOPAPR |
| | | | | TPB PSB07,PRECOND |
| 7006 | A647 | 0047 | | |
| 7008 | 90 | 0000 | | |
| 7009 | 3C7D | 707D | | BNZ EC0K5 |
| 700B | A662 | 0062 | | LB CEMODE |
| 700D | A803 | 0003 | | CI CENOPAPR |
| 700F | 3D7D | 707D | | BE EC0K5 |
| | | | | 1. THEN |
| | | | | 2. . IF CR1 |
| 7011 | E4 | 0004 | | LR CRREG |
| 7012 | 97 | 0007 | | TP CR1 |
| 7013 | 3D7D | 707D | | BZ EC0K5 |
| | | | | 2. . THEN |
| | | | | 3. . . RESET ALL TRUCKS |
| 7015 | A671 | 0071 | | LB PCB02 |
| | | | | TRM P (DPLXTRCK,ALTTRUCK,PRMTRCK) RESET ALL TRUCKS FIRST |
| 7017 | ABE3 | 00E3 | | |
| 7019 | 29 | | | TRA |
| | | | | 3. . . IF SEPSTBY |

TABLE VIII-continued

| LOC | OBJ | OP1 | OP2 | SOURCE STATEMENT | | |
|---|---|---|---|---|---|---|
| | | | | | EC0 CR1 CODE | |
| | | | | TPB | PLSTNDBY,SEPSTBY | |
| 701A | A653 | 0053 | | | | |
| 701C | 95 | 0005 | | | | |
| 701D | 43 | 7023 | | JZ | EC0K1 | *GO TO NEXT TEST IF NOT SEPARATION |
| | | | | 3. . . THEN | | |
| | | | | 4. . . . SET ALTERNATE TRUCK | | |
| 701E | 29 | | | TRA | RETURN TRUCK STATUS BYTE | |
| 701F | AF08 | 0003 | | TS | ALTTRUCK SET ALTERNATE TRUCK | |
| 7021 | 2C61 | 7061 | | B | EC0K4 | |
| | | | | NONPERTINENT CODE | | |

The next synchronous program pertinent to practicing the present invention is the EC2 routine shown in FIG. 13. After the nonpertinent code at location 7188, the processor checks at step 718A whether the separate indicator (SEPARIND) is set plus some other conditions set forth in Table IX. If it is not set and the other conditions are met, the original on the platen of the SADF 11 is exited by the step 71B5. Otherwise, the "Remove Original Light" (not shown) on the panel 52 is illuminated by the step 71C0. At step 71C6, the REmove COPY 1 flag is tested. If set, then at step 71CB the indicated flags and the CR field are reset. Nonpertinent code is executed at step 71DC and the program is exited. The program details are shown below in Table IX.

TABLE IX

| LOC | OBJ | OP1 | OP2 | SOURCE STATEMENT | | |
|---|---|---|---|---|---|---|
| | | | | | EC2 CODE | |
| | | | | NONPERTINENT CODE | | |
| | | | | 5. . . . . IF | | (¬COLBNFL &¬SEPARATE &(¬B4 \|(¬BNLGTB4 & (SELPAPE \|SELPAPD \|SELPAPC \|SELPAPB)) \|(SELPAPE &¬IMPACTU) \|((SELPAPD \|SELPAPC \|SELPAPB) &IMPACTU))) |
| | | | | | RIN | CSB14 |
| 718A | A6D5 | 00D5 | | | | |
| 718C | 91 | 0001 | | | TP | COLBNFL |
| 718D | 3CC0 | 71C0 | | | BNZ | EC2COL3 |
| | | | | | TPB | PCB06,SEPARIND -- Separate mode. |
| 718F | A677 | 0077 | | | | |
| 7191 | 92 | 0002 | | | | |
| 7192 | 3CC0 | 71C0 | | | BNZ | EC2COL3 -- EC2 time. |
| 7194 | A6A1 | 01A1 | | | LBL | COUNTRY |
| 7196 | 92 | 0002 | | | TP | B4 |
| 7197 | 3DB5 | 71B5 | | | BZ | EC2COL2E |
| | | | | | RIN | CSB13 |
| 7199 | A6D4 | 00D4 | | | | |
| 719B | 29 | | | | TRA | |
| | | | | | RIN | CSB14 |
| 719C | A6D5 | 00D5 | | | | |
| 719E | 97 | 0007 | | | TP | BNLGTB4 |
| 719F | 29 | | | | TRA | |
| 71A0 | 65 | 71A5 | | | JNZ | EC2COL2A |
| 71A1 | AB1E | 001E | | | NI | P(SELPAPE,SELPAPD,SELPAPC,SELPAPB) |
| 71A3 | 3CB5 | 71B5 | | | BNZ | EC2COL2E |
| | | 71A5 | | EC2COL2A | DC | * |
| 71A5 | 94 | 0004 | | | TP | SELPAPE |
| 71A6 | 4C | 71AC | | | JZ | EC2COL2B |
| 71A7 | A681 | 0181 | | | LBL | PSB65 |
| 71A9 | 90 | 0000 | | | TP | IMPACTU |
| 71AA | 45 | 71B5 | | | JZ | EC2COL2E |
| 71AB | 03 | 71B3 | | | J | EC2COL2C |
| | | 71AC | | EC2COL2B | DC | * |
| 71AC | AB0E | 000E | | | NI | P(SELPAPD,SELPAPC,SELPAPB) |
| 71AE | 43 | 71B3 | | | JZ EC2COL2C | |
| 71AF | A681 | 0181 | | | LBL | PSB65 |
| 71B1 | 90 | 0000 | | | TP | IMPACTU |
| 71B2 | 65 | 71B5 | | | JNZ | EC2COL2E |
| | | 71B3 | | EC2COL2C | DC | * |
| 71B3 | 2CC0 | | | | B | EC2COL3 |
| | | | | 5. . . . . THEN | | |
| | | 71B5 | | EC2COL2E | DC | * |
| | | | | 6. . . . . EXITOFLO=1 -- Exit original from SADF. | | |
| | | | | | SRG | COLRG |
| 71B5 | A9D0 | 00D0 | | | | |
| | | | | | TSB | CPSB05,EXITOFLO |
| 71B7 | A616 | 0016 | | | | |
| 71B9 | AF20 | 0005 | | | | |
| 71BB | A116 | 0016 | | | | |
| | | | | | SRG | INTHRG |
| 71BD | A9C8 | 00C8 | | | | |
| 71BF | 06 | 71C6 | | | J | EC2COL4 |
| | | | | 5. . . . . ELSE | | |

TABLE IX-continued

```
                                                    EC2 CODE
LOC  OBJ    OP1  OP2        SOURCE STATEMENT
            71C0        EC2COL3     DC          *
                            6. . . . . . REMOCOPYI=1
                                        TSB         PCB05,REMCOPYI
71C0 A676   0076
71C2 AF01   0000
71C4 A176   0076
                            5. . . . . ENDIF
                            4. . . . ENDIF
                            3. . . ENDIF
            71C6        EC2COL4     DC          *
                            3. . . IF REMCOPYI
                                        TPB         PCB05,REMCOPYI
71C6 A676   0076
71C8 90     0000
71C9 3DDC   71DC                        BZ          EC2A
                            3. . . THEN
                            4. . . . DEACTIVATE CR1 &RESET
                                                    (CRB,CRA,CRA0,CRA1,CRA3,CRA4,CRA5)
71CB E4     0004                    LR          CRREG       LOAD OR REGISTERS' REGISTER
71CC B7     0007                    TR          CR1         DEACTIVATE CR1
71CD 84     0004                    STR         CRREG       STORE OR REGISTERS' REGISTER
71CE 25                             CLA         CLEAR ACCUM
71CF A114   0014                    STB         CRHI        RESET HIGH BYTE OF CR REGISTER
                            4. . . . RESET STARTL
                                        TRB         PSB22,STARTL
71D1 A656   0056
71D3 B6     0006
71D4 A156   0056
                            4. . . . RESET FLUSH_PLEASE_STANDBY (FLSHPLSB) AND
                                                    SEPARATION_PLEASE_STANDBY (SEPSTBY)
                                        TRMB        PLSTNDBY,P(FLSHPLSB,SEPSTBY)
71D6 A653   0053
71D8 ABDB   00DB
71DA A153   0053
                            3. . . ENDIF
                            2. . ENDIF
                            1. ENDIF
                            NONPERTINENT CODE
```

The computer responds to the EC5 routine with respect to the separation mode as shown in FIG. 14. First, the CR2 bit is checked by the step 7367 whether the inner image erase lamp should be turned off as the image area is just beginning to pass the interimage erase lamp 30E. At step 736C, a check whether the next operation is not auxiliary to copy production is made. During auxiliary operations (copies not produced) such as the separation mode, the inner image erase lamp 30E is left on to erase the image area. A flush mode, separate mode, preconditioning, or other auxiliary functions of a copy production machine require no image transfers. If copy production is to ensue, then the inter-image erase lamp 30E is turned off by the step 737F to allow an image to be imposed upon the image area of the photoconductor drum 20. Nonpertinent code at location 7386 completes the EC5 code. The program details are in Table X.

Similarly, the EC6 code shown in FIG. 15 enables the computer to control the document lamp. After the nonpertinent code at location 73E5, the processor at step 73E9 checks CR2 and END, i.e., whether this is the last time CR2 will be used in the particular copy production run. If so, then at step 73F2 the processor checks for separation mode (SEPSTBY) and a delay start, i.e., whether this is a leading separation mode run which is a separation mode run followed by copy production run. If so, then the document lamp is turned on by the step 73FA. Otherwise, nonpertinent code at location 7402 is executed. The program details are shown in Table XI.

TABLE X

```
                                                    EC5 CODE
LOC  OBJ    OP1  OP2    SOURCE STATEMENT
                        BEGIN EC5 CODE
            7367            DC          *
                        1. IF CR2
7367 A604   0004            LB          CRREG       LOAD CR REGISTERS' REGISTER
7369 96     0006            TP          CR2         TEST FOR CR2
736A 3D86   7386            BZ          EC5A        IF CR2 NOT ACTIVE JUMP TO CR3 TEST
                        1. THEN
                        2. . IF ¬FLUSH & ¬FUSER BYPASS & ¬PRECOND & (¬SEPSTBY)
                            TP          PLSTNDBY,FSRPLSB
736C A653   0053
736E 91     0001
736F 3C86   7386            BNZ         EC5A
7371 A647   0047            LB          PSB07       GET STATUS
                            TSM         P(PRECOND,FLUSH)
7373 AF03   0003
```

TABLE X-continued

EC5 CODE

| LOC | OBJ | OP1 | OP2 | SOURCE STATEMENT | | |
|---|---|---|---|---|---|---|
| 7375 | 3C86 | 7386 | | BNZ | EC5A | |
| | | | | TPB | PLSTNDBY,SEPSTBY | |
| 7377 | A653 | 0053 | | | | |
| 7379 | 95 | 0005 | | | | |
| 737A | 4F | 737F | | JZ | EC5S1 | |
| 737B | EE | 000E | | LR | ACRREG | |
| 737C | ABF0 | 00F0 | | NI | X'F0' | |
| 737E | 46 | 7386 | | JZ | EC5A | |
| | | | | 2. . THEN | | |
| | | 737F | | DC EC551 | * | |
| | | | | 3. . . INTERIMAGE ERASE OFF | | |
| 737F | A67D | 007D | | LB | PCB15 | |
| 7381 | B4 | 0004 | | TR | INTIMGER | |
| | | | | STOUT | 15 | |
| 7382 | A17D | 007D | | STB | PCB15 | |
| 7384 | A1D6 | 00D6 | | STB | CCB15 | |
| | | | | 2. . ENDIF | | |
| | | | | 1. . ENDIF | | |
| | | | | NONPERTINENT CODE | | |

TABLE XI

EC6 CODE

| LOC | OBJ | OP1 | OP2 | SOURCE STATEMENT | | |
|---|---|---|---|---|---|---|
| | | | | 1. IF CR2 & END | | |
| 73E9 | E4 | 0004 | | LR | CRREG | GET CR REG |
| 73EA | 96 | 0006 | | TP | CR2 | SEE IF CR2 |
| 73EB | 3512 | 7412 | | BZ | EC6B | *GO IF YES |
| | | | | TPB | PSB03,END | |
| 73ED | A643 | 0043 | | | | |
| 73EF | 97 | 0007 | | | | |
| 73F0 | 3512 | 7412 | | BZ | EC6B | |
| | | | | 1. THEN | | |
| | | | | 2. . IF SEPSTBY & DELAYSTL | | |
| | | | | TPB | PLSTNDBY,SEPSTBY | |
| 73F2 | A653 | 0053 | | | | |
| 73F4 | 95 | 0005 | | | | |
| 73F5 | 42 | 7402 | | JZ | EC6A | |
| | | | | TPB | PSB03,DELAYSTL | |
| 73F6 | A643 | 0043 | | | | |
| 73F8 | 92 | 0002 | | | | |
| 73F9 | 42 | 7402 | | JZ | EC6A | |
| | | | | 2. . THEN | | |
| | | | | 3. . . DOCLAMP | ON | |
| | | | | TSB | PCB12,DOCLAMP | |
| 73FA | A67A | 007A | | | | |
| 73FC | AF10 | 0004 | | | | |
| 73FE | A17A | 007A | | | | |
| 7400 | 2C12 | 7412 | | B | EC6B | |
| | | | | NONPERTINENT CODE | | |

Figure 16:
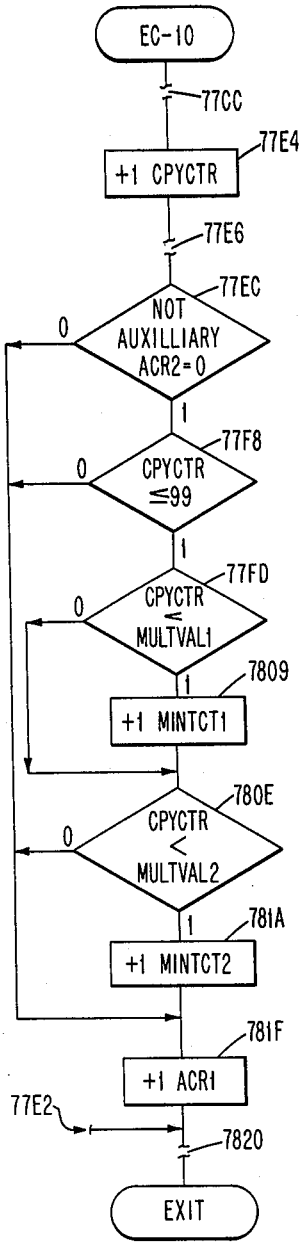
FIG. 16 is a flowchart of the EC10 process.

The EC10 routine, among other things, provides for incrementing certain counters. As seen in FIG. 16, after executing the nonpertinent code at location 77CC which verifies that CR2 is set and that paper has been satisfactorily picked, the copy counter (CPYCTR) is incremented by the step 77E4. This counter is used to count the number of separation sheets used during the separation mode as well as counting copies in copy production runs. Following more nonpertinent code at location 77E6, which includes a series of branches and counting steps not directly pertinent to the separation mode, the step 77EC senses whether an auxiliary function is being performed. If an auxiliary function is not being performed, the ACR1 register is incremented by the step 781F. The ACR register contains a count indicating the number of copies produced from a given image and is used primarily for copy error recovery. ACR1 is also a count which keeps a tally of the number of copies in the paper path when one image is being produced or, if no images are being transferred, counts separation sheets. The code from location 77F8 through location 781A concerns counting steps pertinent to copy production. More nonpertinent code at location 7820 or from a branch of nonpertinent code at step 77E2 is executed before the program is exited. The Table XII below shows the program details.

TABLE XII

EC10 COUNT CONTROL CODE

| LOC | OBJ | OP1 | OP2 | SOURCE STATEMENT | | |
|---|---|---|---|---|---|---|
| | | | | 4. . . . INCREMENT COPY COUNTER-CPYCTR=CCTRSAVE | | |
| 77E4 | E5 | 0005 | | LR | CCTRSAVE | |
| 77E5 | B7 | 0007 | | STR | CPYCTR | |
| | | | | 4. . . . IF ¬CENOPAPR | | |
| 77E6 | A662 | 0062 | | LB | CEMODE | GET CEMODE |

TABLE XII-continued

EC10 COUNT CONTROL CODE

```
LOC   OBJ   OP1   OP2   SOURCE STATEMENT
77E8  A803  0003        CI     CENOPAPR     SEE IF CE NO PAPER MODE
77EA  3520  7820        BE     EC10B        *GO IF YES
                    4. . . . THEN
                    5. . . . . IF ¬FLUSH & ¬(SEPACTV & ACR2=0)
77EC  A647  0047        LB     PSB07        GET STATUS
77EE  91    0001        TP     FLUSH        TEST FOR FLUSH
77EF  341F  781F        BNZ    EC10D3
77F1  93    0003        TP     SEPACTV      TEST FOR SEPATATION MODE
77F2  48    77F8        JZ     EC10Z        *GO IF NO
77F3  EE    000E        LR     ACRREG       LOAD ACR REGISTER
77F4  ABF0  00F0        NI     X'F0'        TEST VALUE OF ACR2
77F6  351F  781F        BZ     EC10D3       *GO IF 0
                    5. . . . . THEN
            77F8  EC10Z DC     *
                    6. . . . . . IF CPYCTR<=99
77F8  25                CLA    CLEAR ACCUM
77F9  A417  0017        AB     CPYCTHI
77FB  341F  781F        BNE    EC10D3
                    6. . . . . . THEN
                    7. . . . . . . IF CPYCTR<MULTVAL1
77FD  A6B6  01B6        LBL    MULTVAL1
                        SHLM   4
77FF  2B
7800  2B
7801  2B
7802  2B
7803  A7B7  01B7        OBL    MULTVAL1+1
7805  A207  0007        SB     CPYCTLU
                        JNC    EC10D2
7807  2D
7808  4E    780E
                    7. . . . . . . THEN
                    8. . . . . . . . INCREMENT MINTCT1
7809  A644  0044        LB     PSB04
780B  2E                A1
780C  A144  0044        STB    PSB04
                    7. . . . . . . ENDIF
            780E  EC10D2 DC    *
                    7. . . . . . . IF CRYCTR<MULTVAL2
780E  A6BE  01BE        LBL    MULTVAL2
                        SHLM   4
7810  2B
7811  2B
7812  2B
7813  2B
7814  A7BF  01BF        OBL    MULTVAL2+1
7816  A207  0007        SB     CPYCTLO
                        JNC    EC10D3
7818  2D
7819  4F    781F
                    7. . . . . . . THEN
                    8. . . . . . . . INCREMENT MINTCT2
781A  A651  0051        LB     PSB17
781C  2E                A1
781D  A151  0051        STB    PSB17
                    7. . . . . . . ENDIF
                    6. . . . . . ENDIF
                    5. . . . . ENDIF
            781F  EC10D3 DC    *
                    5. . . . . INCREMENT ACR1
781F  FE    000E        LRB    ACRREG
                    4. . . . ENDIF
                    3. . . ENDIF
```

Figure 17:
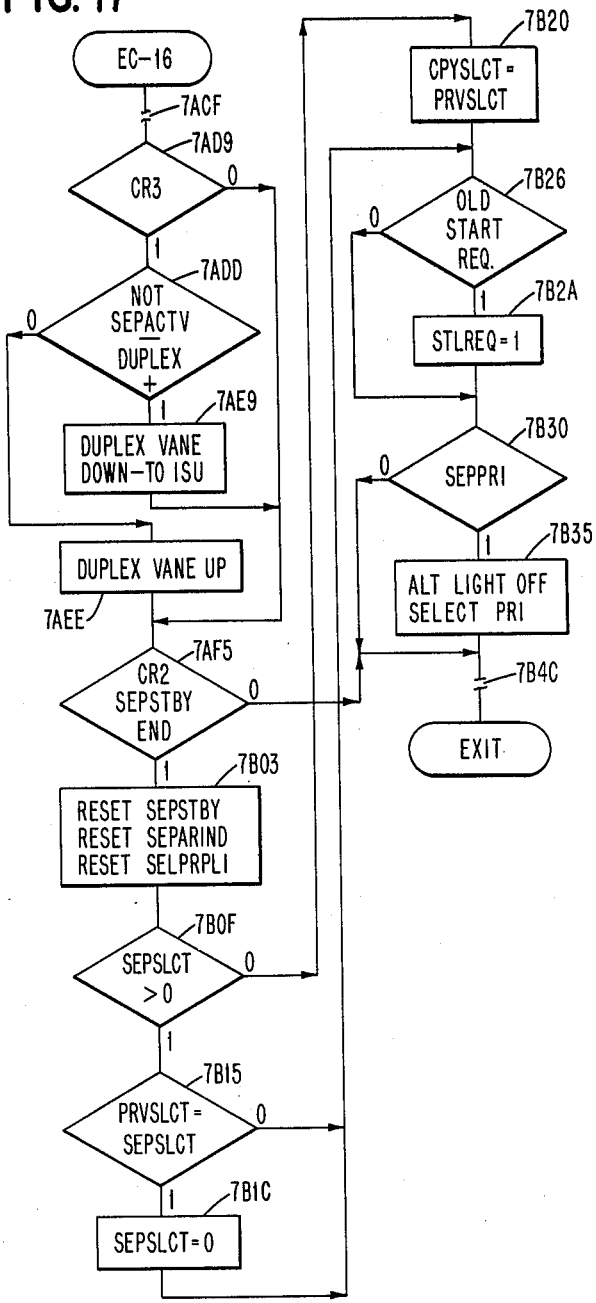
FIG. 17 is a flowchart of the EC16 process.

The last synchronous program portion to be described is EC16 shown in FIG. 17. After executing nonpertinent code at location 7ACF, the status of the CR3 bit is sensed by the step 7AD9. If set, then at step 7ADD the processor senses whether the separation mode is not active and whether the duplex mode is active. If true, the step 7AE9 moves the duplex vane down so that copies will go to the ISU 40. On the other hand, if the separate mode is active or the duplex mode is inactive, then the step 7AEE enables the processor to move the duplex vane up for directing copy sheets to the output section 14.

At step 7AF5 the processor checks CR2, SEParate STandBY, and END to ascertain whether the last separation sheet has been picked from the alternate paper bin 54. If so, then the step 7B03 enables the processor to reset SEParate STandBY, SEPARate INDicator and the SELect Primary Paper bin flags.

Following the step 7B03, the processor checks by step 7B03 whether the separation selection value is greater than zero. If so, then by the step 7B15, the previous separation select value (PRVSLCT) is compared for equality with the present separation select value. The previous select is a stored value for indicating to other programs the number of separation sheets transported during the previous separation mode run. If equal, the processor at step 7B1C clears the separation select value to zero (end of the separation run).

If, on the other hand, the separation select at step 7BOF were not greater than zero, i.e., equal to zero, then at step 7B20, the copy select count is made equal to the previous separation select count.

At step 7B26, the program paths join where the computer senses whether there is an outstanding start request. If so, the STart Latch REQuest flag is set by the step 7B2A. At step 7B30, the processor checks whether the copies previously made used copy sheets from the primary paper bin 35. If the copies were made from the primary bin, which is the usual case, the alternate light is turned off and the primary bin is selected at 7B35. After executing nonpertinent code at 7B4C, the program is exited. If the branch at step 7AF5 indicates that the end of the separation run has not occurred or that other conditions outside the realm of separation runs have occurred, the program is then exited via the nonpertinent code 7B4C. The program details for the above-described flowchart are shown in Table XIII.

TABLE XIII

EC16 SEPARATION MODE CODE

| LOC | OBJ | OP1 | OP2 | SOURCE STATEMENT | | |
|---|---|---|---|---|---|---|
| | | | | 1. IF CR3 | | |
| 7AD9 | E4 | 0004 | | LR | CRREG | GET CR REGISTER |
| 7ADA | 95 | 0005 | | TP | CR3 | TEST FOR CR3 |
| 7ADB | 3DF5 | 7AF5 | | BZ | EC16C | *GO IF NO |
| | | | | 1. THEN | | |
| | | | | 2. . IF ¬SEPACTV &DUPLEX IND &¬SIDE2 | | |
| | | | | TPB | PSB07,SEPACTV | |
| 7ADD | A647 | 0047 | | | | |
| 7ADF | 93 | 0003 | | | | |
| 7AE0 | 6E | 7AEE | | JNZ | EC16B | *GO IF YES |
| | | | | TPB | PCB05,DPLXIND | |
| 7AE1 | A676 | 0076 | | | | |
| 7AE3 | 92 | 0002 | | | | |
| 7AE4 | 4E | 7AEE | | JZ | EC16B | *GO IF NO |
| | | | | TPB | PSB20,DPXSIDE2 | |
| 7AE5 | A654 | 0054 | | | | |
| 7AE7 | 95 | 0005 | | | | |
| 7AE8 | 6E | 7AEE | | JNZ | EC16B | *GO IF YES |
| | | | | 2. . THEN | | |
| | | | | 3. . . DUPLEX VANE DOWN | | |
| 7AE9 | A673 | 0073 | | LB | PCB02 | GET STATUS |
| 7AEB | AF40 | 0006 | | TS | DPLXVANE | |
| 7AED | 01 | 7AF1 | | J | EC16B1 | * CONTINUE |
| | | | | 2. . ELSE | | |
| | | 7AEE | EC16B | DC | * | |
| | | | | 3. . . DUPLEX VANE UP | | |
| 7AEE | A673 | 0073 | | LB | PCB02 | GET STATUS |
| 7AF0 | B6 | 0006 | | TR | DPLXVANE | |
| | | 7AF1 | EC16B1 | DC | * | |
| | | | | STOUT | 02 | |
| 7AF1 | A173 | 0073 | | STB | PCB02 | |
| 7AF3 | A1C1 | 00C1 | | STB | CCB02 | |
| | | | | 2. . ENDIF | | |
| | | 7AF5 | EC16C | DC | * | |
| | | | | 1. ENDIF | | |
| | | | | 1. IF CR2 &END &SEPSTBY | | |
| 7AF5 | E4 | 0004 | | LR | CRREG | GET CR REGISTER |
| 7AF6 | 96 | 0006 | | TP | CR2 | TEST FOR CR2 |
| 7AF7 | 354C | 7B4C | | BZ | EC16E | *GO IF NO |
| | | | | TPB | PSB03,END | |
| 7AF9 | A643 | 0043 | | | | |
| 7AFB | 97 | 0007 | | | | |
| 7AFC | 354C | 7B4C | | BZ | EC16E | *GO IF END NOT SET |
| 7AFE | A653 | 0053 | | LB | PLSTNDBY | |
| 7B00 | B5 | 0005 | | TR | SEPSTBY | |
| 7B01 | 3D4C | 7B4C | | BZ | EC16E | *GO IF NOT SEPARATE |
| | | | | 1. THEN | | |
| | | | | 2. . RESET SEPSTBY,SEPARATION LIGHT,SELPRPLI | | |
| 7B03 | A153 | 0053 | | STB | PLSTNDBY | |
| | | | | TRB | PCB06,SEPARIND | |
| 7B05 | A677 | 0077 | | | | |
| 7B07 | B2 | 0002 | | | | |
| 7B08 | A177 | 0077 | | | | |
| | | | | TRB | PCB13,SELPRPLI | |
| 7B0A | A67D | 007D | | | | |
| 7B0C | B4 | 0004 | | | | |
| 7B0D | A17D | 007D | | | | |
| | | | | 2. . IF SEPSLCT>0 | | |
| 7B0F | 25 | | | CLA | | |
| | | | | SRG | BASERG | |
| 7B10 | A9C9 | 00C9 | | | | |
| 7B12 | D9 | 0009 | | AR | SEPSLCT | |
| 7B13 | 3D20 | 7B20 | | BZ | EC16C5 | |
| | | | | 2. . THEN | | |
| | | | | 3. . . IF PRVSLCT=SEPSLCT | | |

TABLE XIII-continued

EC16 SEPARATION MODE CODE

```
LOC   OBJ   OP1   OP2    SOURCE STATEMENT
                            SRG     COLRG
7B15  A9D0  00D0
7B17  EA    000A            LR      PRVSLCT
                            SRG     BASERG
7B18  A9C9  00C9
7B1A  C9    0009            SR      SEPSLCT
7B1B  6D    7B1D            JNZ     EC16C1
                        3. . . THEN
                        4. . . . SEPSLCT=0
7B1C  89    0009            STR     SEPSLCT
                        3. . . ENDIF
                     EC16C1 SRG     INTHRG
7B1D  A9CB  00C8
7B1F  06    7B26            J       EC16C7
                        2. . ELSE
            7B20     EC16C5 DC      *
                        3. . . CPYSLCT=PRVSLCT
                            SRG     COLRG
7B20  A9D0  00D0
7B22  EA    000A            LR      PRVSLCT
                            SRG     INTHRG
7B23  A9C8  00C8
7B25  89    0009            STR     CPYSLCT
                        2. . ENDIF
            7B26     EC16C7 DC      *
                        2. . IF DELAYSTL
                            TPB     PSB03,DELAYSTL
7B26  A643  0043
7C28  92    0002
7B29  40    7B30            JZ      EC16D
                        2. . THEN
                        3. . . SET STLREQ
                            TSB     PSB22,STLREQ
7B2A  A656  0056
7B2C  AF80  0007
7B2E  A156  0056
                        2. . ENDIF
            7B30     EC16D  DC      *
                        2. . IF SEPPRI
                            TPB     PSB05,SEPPRI
7B30  A645  0045
7B32  93    0003
7B33  3D4C  7B4C            BZ      EC16E
                        2. . THEN
                        3. . . TURN OFF ALTERNATE BIN LIGHT
                            TRB     PCB05,ALTPAPI
7B35  A676  0076
7B37  B1    0001
7B38  A176  0076
                        3. . . PICK PRIMARY TRUCK (RESET OTHERS)
7B3A  A673  0073            LB      PCB02
                            TRM     P(ALTTRUCK,DPLXTRCK)
7B3C  ABF3  00F3
7B3E  AF10  0004            TS      PRMTRCK
7B40  A173  0073            STB     PCB02
                        3. . . SET PRIMPICK (RESET OTHERS)
7B42  A670  0070            LB      PCB16
7B44  AF08  0003            TS      PRIMPICK
                            TRM     P(ALTPICK,DUPPICK)
7B46  ABCF  00CF
                            STOUT   16
7B48  A170  0070            STB     PCB16
7B4A  A1DA  00DA            STB     CCB16
                        2. . ENDIF
                        1. ENDIF
```

Interleaved with execution of the synchronous programs are the asynchronous programs 260, 261. The asynchronous programs 261 are directed toward job control of the copy production machine 10. These programs tie the various copy production runs and separation runs and flush runs together for completing a job, particularly as to extending logically the storage capacity of the collators in the output section 14.

Figure 18:
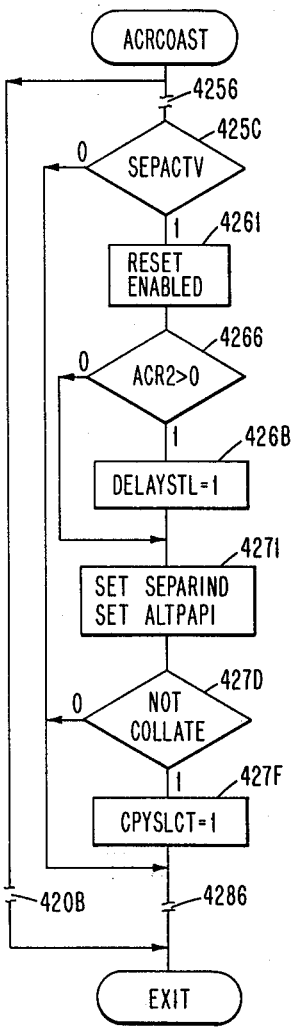
FIG. 18 is a flowchart of the ACRCOAST process.

A first of these job control asynchronous programs is shown in FIG. 18 which is executed each time the machine 10 stops, i.e., when the photoconductor drum 20 has stopped rotating. At this time, many tasks have to be performed by the processor relating to the next startup of the copy production machine 10 so that job continuity can be preserved or so that a job can be terminated. The programming at the end of such a run is quite complex, having an effect on all the operational features of the copy production machine. Accordingly, the nonpertinent code indicated at 4256, 420B, and 4286 is substantial. That portion of the ACRCOAST routine that pertains to the separation mode includes the step 425C by which the processor senses whether the copy production machine is in a separation mode run (SEPACTV). If it is, then at step 4261 the processor resets the ENABLED flag, thereby disabling the processor from sensing input operating parameters. At the step 4266, the processor determines whether the value in a copy recovery register ACR2 is greater than zero. If it is greater than zero, then an ensuing copy production run will be overlapped with the present separation run. This overlap is indicated by delaying the start at step 426B by setting the DELAYSTL flag. The delayed start memorizes that a start has been requested and will be used by other programs executed by the processor.

At step 4271, the processor sets the separate indicate flag SEPARIND which turns on the separate indicator light associated within the switch 57 on the panel 52. The alternate paper supply 54 is selected. At the step 427D, the processor determines whether the collate mode has been selected by the operator. If so, the nonpertinent code at location 4286 is executed. On the other hand, if collate was not selected, then the copy select value is set equal to one at the step 427F. Thus, only one separation sheet will be supplied in a noncollate mode to the exit tray 14A. The program details associated with the flowchart are listed in Table XIV below.

TABLE XIV

ACR COAST

| LOC | OBJ | OP1 | OP2 | SOURCE STATEMENT | | |
|---|---|---|---|---|---|---|
| | | | | 2. . IF SEPACTV | | |
| | | | | TPB | PSB07,SEPACTV | |
| 425C | A647 | 0047 | | | | |
| 425E | 93 | 0003 | | | | |
| 425F | 3D86 | 4286 | | BZ | ACRCP02 | |
| | | | | 2. . THEN | | |
| | | | | 3. . . RESET ENABLED | | |
| | | | | TRB | PSB42,ENABLED | |
| 4261 | A66A | 006A | | | | |
| 4263 | B7 | 0007 | | | | |
| 4264 | A1CA | 006A | | | | |
| | | | | 3. . . IF ACR2]0 | | |
| 4266 | A60E | 000E | | LB | ACRREGLO | |
| 4268 | ABF0 | 00F0 | | NI | X'F0' | |
| 426A | 41 | 4271 | | JZ | ACRCPX1 | |
| | | | | 3. . . THEN | | |
| | | | | 4. . . . SET DELAYSTL - IMPLIES SEPARATION OVERLAPPED BY COPY | | |
| | | | | TSB | PSB03,DELAYSTL | |
| 426B | A643 | 0043 | | | | |
| 426D | AF04 | 0002 | | | | |
| 426F | A143 | 0043 | | | | |
| | | | | 3. . . ENDIF | | |
| | | | ACRCPX1 | EQU | * | |
| | | | | 3. . . SET ALTPAPI, SEPARIND | | |
| | | | | TSB | PCB05,ALTPAPI | |
| 4271 | A676 | 0076 | | | | |
| 4273 | AF02 | 0001 | | | | |
| 4275 | A176 | 0076 | | | | |
| | | | | TSB | PCB06,SEPARIND | PCB06 LEFT IN ACCUM FOR NEXT INSTR. |
| 4277 | A677 | 0077 | | | | |
| 4279 | AF04 | 0002 | | | | |
| 427B | A177 | 0077 | | | | |
| | | | | 3. . . IF .COLATIND | | |
| 427D | 91 | 0001 | | TP | COLATIND | PCB06 STILL IN ACCUM FROM PRV. INSTR |
| 427E | 66 | 4286 | | JNZ | ACRCP02 | |
| | | | | 3. . . THEN | | |
| | | | | 4. . . . CPYSLCT=1 | | |
| 427F | 25 | | | CLA | | |
| 4280 | 2E | | | AI | | |
| | | | | SRG | INTHRG | |
| 4281 | A9C8 | 00C8 | | | | |
| 4283 | 89 | 0009 | | STR | CPYSLCT | |
| | | | | SRG | BASERG | |
| 4284 | A9C9 | 00C9 | | | | |
| | | | | 3. . . ENDIF | | |
| | | | | 2. . ENDIF | | |
| | | | | NONPERTINENT CODE | | |

Figure 19:
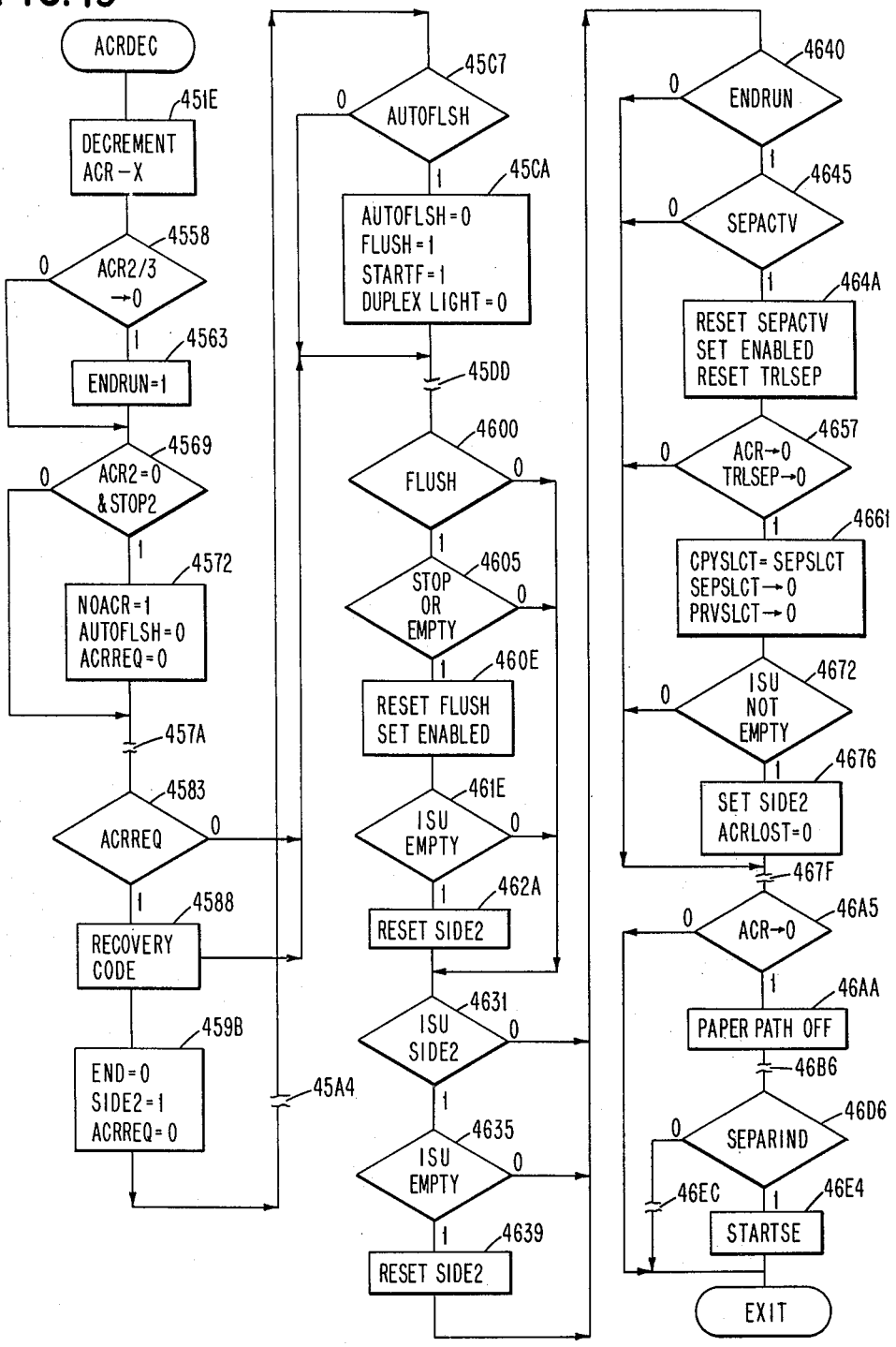
FIG. 19 is a flowchart of the ACRDEC process.

An important job control asynchronous program ACRDEC is shown in FIG. 19. The ACR count fields are divided into a plurality of subfields. For example, ACR1 is a count field indicating a number of copies of a given image just entering the copy path of the copy production machine 10. ACR2 is a count field of copies of a single image different from and preceding the copies associated with ACR1. Similarly, ACR3, -4, -5 and so forth, indicate the number of copies of preceding images. As copies leave the copy path as sensed by the switches S2 through S4 (FIG. 1), the highest order, non-zero ACR count field is decremented. This ACR is designated as ACRX. Accordingly, as each copy leaves the copy path the processor executes the step 451E to decrement ACRX. As a result, the numerical content of the various ACR count fields indicates the number of copies of each respective image currently in the copy production routine copy path.

After decrementing ACRX, the processor by step 4558 determines whether ACR2 or 3 has just been decremented to zero. If either of these have been decremented to zero, the ENDRUN flag is set at step 4563. This flag indicates that the copy path now contains the copies of the last image. When more than one ACR count field is nonzero, the number of copies made from each image is less than that necessary to fill the copy path completely. When the higher numbered ACRs have all been decremented to zero, including ACR2 or 3, then only the copies of the last image remain in the copy path. The ENDRUN flag is an indication that the end of a run is imminent.

At step 4569, the processor senses whether ACR2 is equal to zero and whether the STOP2 flag is set. If so, then at step 4572 the processor flags that no copy recovery (NOACR and ACRREQ=0) is required and that there is no requirement for emptying the ISU 40 (AUTOFLSH=0). Next, some nonpertinent code at location 457A is executed.

The step 4583 determines whether an error recovery request has been made. If not, nonpertinent code beginning at location 45DE is executed. Otherwise, certain recovery code indicated at step 4588 is executed.

At step 45DD, the processor resets the END flag, sets the SIDE2 flag and resets the error recovery request. After executing nonpertinent code location 45A4, the step 45C7 checks whether the ISU 40 is to be emptied (AUTOFLSH). If so, the AUTOFLSH flag is reset, the FLUSH is set indicating that the ISU 40 will be emptied, START F flag is set, and the duplex light on the panel 52 is extinguished. After executing the nonpertinent code at location 45DD, the processor checks by the step 4600 whether the flush indicator is set. If set, then at step 4605 the processor checks whether the stop indicator is set or the ISU 40 is empty. If either one of the conditions exist, then at step 460E, the FLUSH flag is reset and ENABLED is set indicating operator selections are permitted because the copy production machine 10 is stopping.

By the step 461E, the processor checks whether the ISU 40 is empty. If so, at step 461E the processor resets the SIDE2 flag by step 462A. The program paths join at step 4631 where the processor checks the SIDE2 flag. If it is set, then at step 4635 the processor again checks whether the ISU 40 is empty. If it is empty, the SIDE2 flag is reset by the step 4639.

At steps 4640 and 4645, the processor checks the ENDRUN flag and whether separate is active. If both conditions exist, then at step 464A, the processor resets the SEParate ACTiVe flag, sets the ENABLED flag for enabling operator input, and resets the TraiLing SEParator flag. From an operator view, when the separate indicator at the button 57 goes off, additional parameters can be entered. When SEPTACTV is reset, other programs, as described, reset SEPARIND.

At step 4657, the processor checks whether any ACR has been decremented to zero and whether the TRaiLing SEParator has been reset. If the conditions exist, then by step 4661 the copy select count is made equal to the separate select value, i.e., the number of copies to be produced will equal the number of separator sheets provided. Also the two values, separate select and previous separate select, are cleared to zero. At step 4672 the processor checks whether the ISU 40 is empty. If not, it sets the SIDE2 flag and clears the ACRLOST value to zero by the step 4676. The ACRLOST value indicates the number of copies lost from ISU 40 in a copy transport malfunction. Nonpertinent code is next executed at location 467F.

At step 46A5, the processor checks whether any ACR has been decremented to zero. If so, at step 46AA the paper pick trucks are reset, i.e., returned to their inactive position. Nonpertinent code is then executed at location 46B6. The SEParate INDicator is tested at step 4606 to determine whether a separation mode should be started at step 46E4. Otherwise, nonpertinent code is executed at location 56EC. The program details of the above-described flowchart are shown below in Table XV.

TABLE XV

ACRDEC

| LOC | OBJ | OP1 | OP2 | SOURCE STATEMENT | | | |
|---|---|---|---|---|---|---|---|
| | | | | BEGIN ACRDEC SUBROUTINE | | | |
| | | | | DECREMENTS THE APPROPRIATE NON-0 $ACR_{-13}$ X | | | |
| | | 4518 | | | | | |
| | | | | NOTE: DO NOT USE ACRBILL2, IT WILL BE USED TO DENOTE THAT ACR2 HAS GONE TO 0, IT CAN BE USED A LITTLE LATER, SEE NEXT NOTE. | | | |
| | | | | NONPERTINENT CODE | | | |
| | | | | DECREMENT ACR_X (WHERE X = 4,3,20R 1: THE FIRST NON-0 COUNTER) . (IF ACR2 GOES TO 0, RESET ACRBILL2) | | | |
| 451E | 25 | | | | CLA | | |
| 451F | A41E | 001E | | | AB | ACRREGHI | |
| 4521 | 3D39 | 4539 | | | BZ | ACRD008 | J MEANS ACR3,4 BOTH 0 |
| 4523 | ABF0 | 00F0 | | | NI | X'F0' | |
| 4525 | A61E | 001E | | | LB | ACRREGHI | |
| 4527 | 6F | 452F | | | JNZ | ACRD009 | J MEANS ACR4 = 0 |
| 4528 | 2A | | | | S1 | | DECREMENT ACR3 |
| 4529 | A11E | 001E | | | STB | ACRREGHI | |
| 452B | 3D58 | 4558 | | | BZ | ACRD008C | J MEANS ACR3 DID GO TO 0 |
| 452D | 2C55 | 4555 | | | B | ACRD007 | |
| 452F | AA10 | 0010 | | ACRD009 | SI | X'10' | DECREMENT ACR4 |
| 4531 | A11E | 001E | | | STB | ACRREGHI | |
| 4533 | ABF0 | 00F0 | | | NI | X'F0' | |
| 4535 | 3D58 | 4558 | | | BZ | ACRD008C | J MEANS ACR4 DID GO TO 0' |
| 4537 | 2C55 | 4555 | | | B | ACRD007 | |
| 4539 | A40E | 000E | | ACRD008 | AB | ACRREGLO | |
| 453B | 3D55 | 4555 | | | BZ | ACRD007 | J MEANS ACR1,2 BOTH 0 |
| 453D | ABF0 | 00F0 | | | NI | X'F0' | |
| 453F | A60E | 000E | | | LB | ACRREGLO | |
| 4541 | 68 | 4548 | | | JNZ | ACRD009A | J MEANS ACR2 = ¬0 |
| 4542 | 2A | | | | S1 | | DECREMENT ACR1 |
| 4543 | A10E | 000E | | | STB | ACRREGLO | |
| 4545 | 3D58 | 4558 | | | BZ | ACRD008C | J MEANS ACR1 DID GO TO 0 |
| 4547 | 05 | 4555 | | | J | ACRD007 | |

TABLE XV-continued

ACRDEC

| LOC | OBJ | OP1 | OP2 | SOURCE STATEMENT | | | |
|---|---|---|---|---|---|---|---|
| 4548 | AA10 | 0010 | | ACRD009A | SI | x'10' | DECREMENT ACR2 |
| 454A | A10E | 000E | | | STB | ACRREGLO | |
| 454C | ABF0 | 00F0 | | | NI | X'F0' | |
| 454E | 65 | 4555 | | | JNZ | ACRD007 | J MEANS ACR2 DID NOT GO TO 0 |
| | | | | | TRB | PSB43,ACRBILL2 | |
| 454F | A66B | 006B | | | | | |
| 4551 | B4 | 0004 | | | | | |
| 4552 | A16B | 006B | | | | | |
| 4554 | 08 | 4558 | | | J | ACRD00BC | |
| | | | | 1. IF THAT ACR_X JUST WENT TO 0 | | | |
| 4555 | 30FE46 | 46FE | 0000 | ACRD007 | BU | ACRD003,R0 ACRD007 MEANS SOME ACR DID NOT GOTO 0 | |
| | | | | ACRD008C | EQU | * ACRD008C MEANS SOME ACR DID GOTO 0 | |
| | | | | 1. THEN | | | |
| | | | | 2. . IF (ACR2 \|ACR3 WENT TO 0) \|END | | | |
| | | | | | TPB | PSB43,ACRBILL2 | |
| 4558 | A66B | 006B | | | | | |
| 455A | 94 | 0004 | | | | | |
| 455B | 43 | 4563 | | | JZ | ACRDY1 | |
| 455C | 25 | | | | CLA | | |
| 455D | DE | 000E | | | AR | ACRREG | |
| 455E | 63 | 4563 | | | JNZ | ACRDY1 | |
| | | | | | TPB | PSB03,END | |
| 455F | A643 | 0043 | | | | | |
| 4561 | 97 | 0007 | | | | | |
| 4562 | 49 | 4569 | | | JZ | ACRDY2 | |
| | | | | 2. . THEN | | | |
| | | | | 4563 ACRDY1 DC * | | | |
| | | | | 3. . . SET ENDRUN | | | |
| | | | | | TSB | PSB43,ENDRUN | |
| 4563 | A66B | 006B | | | | | |
| 4565 | AF40 | 0006 | | | | | |
| 4567 | A16B | 0006B | | | | | |
| | | | | 2. . ENDIF | | | |
| | | 4569 | | ACRDY2 | DC | * | |
| | | | | 2. . IF ACR2=0 & STOP2 | | | |
| 4569 | A60E | 000E | | | LB | ACRREGLO | |
| 456B | ABF0 | 00F0 | | | NI | X'F0' | |
| 456D | 6A | 457A | | | JNZ | ACRD01 | |
| | | | | | TPB | PSB23,STOP2 | |
| 456E | A657 | 0057 | | | | | |
| 4570 | 91 | 0001 | | | | | |
| 4571 | 4A | 457A | | | JZ | ACRD01 | |
| | | | | 2. . THEN | | | |
| | | | | 3. . . NOACR=1, AUTOFLSH=0, ACRREQ=0 | | | |
| 4572 | A641 | 0041 | | | LB | PSB01 | |
| 4574 | AF01 | 0000 | | | TS | NOACR | |
| | | | | | TRM | P(AUTOFLSH,ACRREQ) | |
| 4576 | ABF9 | 00F9 | | | | | |
| 4578 | A141 | 0041 | | | STB | PSB01 | |
| | | | | 2. . ENDIF | | | |
| | | | | NONPERTINENT CODE | | | |
| | | | | 3. . . IF ACRREQ | | | |
| | | | | | TPB | PSB01,ACRREQ | |
| 4583 | A641 | 0041 | | | | | |
| 4585 | 91 | 0001 | | | | | |
| 4586 | 3DDD | 45DD | | | BZ | ACRD02 | |
| | | | | 3. . . THEN | | | |
| | | | | RECOVERY CODE 4588 | | | |
| | | | | 5. . . . . THEN | | | |
| | | | | 6. . . . . RESET END,ENDRUN | | | |
| | | | | | TSB | PSB43,ENDRUN | |
| 459B | A66B | 006B | | | | | |
| 459D | AF40 | 0006 | | | | | |
| 459F | A16B | 006B | | | | | |
| | | | | NONPERTINENT CODE | | | |
| | | | | 6. . . . . IF AUTOFLSH | | | |
| 45C7 | B2 | 0002 | | | TR | AUTOFLSH | |
| 45C8 | 3DDD | 45DD | | | BZ | ACRD05 | |
| | | | | 6. . . . . THEN | | | |
| | | | | 7. . . . . RESET AUTOFLSH | | | |
| 45CA | A141 | 0041 | | | STB | PSB01 | |
| | | | | 7.. . . . . FLUSH, STARTFL = 1 | | | |
| | | | | | TSB | PSB07,FLUSH | |
| 45CC | A647 | 0047 | | | | | |
| 45CE | AF02 | 0001 | | | | | |
| 45D0 | A147 | 0047 | | | | | |
| | | | | | TSB | PSB22,STARTFL | |
| 45D2 | A656 | 0056 | | | | | |
| 45D4 | AF01 | 0000 | | | | | |
| 45D6 | A156 | 0056 | | | | | |

TABLE XV-continued

ACRDEC

| LOC | OBJ | OP1 | OP2 | SOURCE STATEMENT |
|---|---|---|---|---|
| | | | | 7. . . . . TURN OFF DUPLEX LIGHT |
| | | | | TRB PCB05,DPLXIND |
| 45D8 | A676 | 0076 | | |
| 45DA | B2 | 0002 | | |
| 45DB | A176 | 0076 | | |
| | | | | 6. . . . . ENDIF |
| | | | | 5.. . . . ENDIF |
| | | | | ACRD05 EQU * |
| | | | | 4. . . . ENDIF |
| | | | | 3. . . ENDIF |
| | | | | NONPERTINENT CODE |
| | | | | 2. . IF FLUSH |
| | | | | TPB PSB07,FLUSH |
| 4600 | A647 | 0047 | | |
| 4602 | 91 | 0001 | | |
| 4603 | 3D31 | 4631 | | BZ ACRL01 |
| | | | | 2. . THEN |
| | | | | 3. . . IF STOP\| ¬COPIES_IN_DUPLEX_SW |
| | | | | TPB PSB23,STOP2 |
| 4605 | A657 | 0057 | | |
| 4607 | 91 | 0001 | | |
| 4608 | 6E | 460E | | JNZ ACRL05 |
| | | | | RIN CSB06 |
| 4609 | A6C5 | 00C5 | | |
| 460B | 92 | 0002 | | TP CPYINDP |
| 460C | 3C2F | 462F | | BNZ ACRLO3 |
| | | | | 3. . . THEN |
| | | | | ACRL05 EQU * |
| | | | | 4. . . . RESET FLUSH, FLSHPLSTBY |
| | | | | TRB PSB07,FLUSH |
| 460E | A647 | 0047 | | |
| 4610 | B1 | 0001 | | |
| 4611 | A147 | 0047 | | |
| | | | | TRB PLSTNDBY,FLSHPLSB |
| 4613 | A653 | 0053 | | |
| 4615 | B2 | 0002 | | |
| 4616 | A153 | 0053 | | |
| | | | | 4. . . . SET ENABLED |
| | | | | TSB PSB42,ENABLED |
| 4618 | A66A | 006A | | |
| 461A | AF80 | 0007 | | |
| 461C | A16A | 006A | | |
| | | | | 4. . . . IF ¬( DUPLEX_LIGHT & STOP & COPIES_IN_DUPLEX_SW ) |
| | | | | TPB PCB05,DPLXIND |
| 461E | A676 | 0076 | | |
| 4620 | 92 | 0002 | | |
| 4621 | 4A | 462A | | JZ ACRL06 |
| | | | | TPB PSB23,STOP2 |
| 4622 | A657 | 0057 | | |
| 4624 | 91 | 0001 | | |
| 4625 | 4A | 462A | | JZ ACRL06 |
| | | | | RIN CSB06 |
| 4626 | A6C5 | 00C5 | | |
| 4628 | 92 | 0002 | | TP CPYINDP |
| 4629 | 6F | 462F | | JNZ ACRL04 |
| | | | | 4. . . . THEN |
| | | | | ACRL06 EQU * |
| | | | | 5. . . . . RESET SIDE-2 |
| | | | | TRB PSB20,DPXSIDE2 |
| 462A | A654 | 0054 | | |
| 462C | B5 | 0005 | | |
| 462D | A154 | 0054 | | |
| | | | | 4. . . . ENDIF |
| | | | | ACRL04 EQU * |
| | | | | 3. . . ENDIF |
| 462F | 2C7F | 467F | | ACRLO3 B ACRL02 |
| | | | | 2. . . ELSE |
| | | | | ACRL01 EQU * |
| | | | | 3. . . IF SIDE-2 |
| | | | | TPB PSB20,DPXSIDE2 |
| 4631 | A654 | 0054 | | |
| 4633 | 95 | 0005 | | |
| 4634 | 40 | 4640 | | JZ ACRL09 |
| | | | | 3. . . THEN |
| | | | | 4. . . . IF ¬COPIES_IN_DUPLEX_SW |
| | | | | RIN CSB06 |
| 4634 | A6C5 | 00C5 | | |
| 4637 | 92 | 0002 | | TP CPYINDP |
| 4638 | 6E | 463E | | JNZ ACRL08 |
| | | | | 4. . . . THEN |

TABLE XV-continued

ACRDEC

| LOC | OBJ | OP1 | OP2 | SOURCE STATEMENT | | |
|---|---|---|---|---|---|---|
| | | | | 5. . . . . RESET SIDE-2 | | |
| | | | | | TRB | PSB20,DPXSIDE2 |
| 4639 | A654 | 0054 | | | | |
| 473B | B5 | 0005 | | | | |
| 463C | A154 | 0054 | | | | |
| | | | | 4. . . . ENDIF | | |
| 463E | 2C7F | 467F | | ACRL08 | B | ACRL07 |
| | | | | 3. . . ELSE | | |
| | | | | ACRL09 | EQU | |
| | | | | 4. . . . IF ENDRUN | | |
| | | | | TPB | | PSB43,ENDRUN |
| 4640 | A66B | 006B | | | | |
| 4642 | 96 | 0006 | | | | |
| 4643 | 3D7F | 467F | | BZ | | ACRL11 |
| | | | | 4. . . . THEN | | |
| | | | | 5. . . . . IF SEPACTV | | |
| 4645 | A647 | 0047 | | | LB | PSB07 |
| 4647 | B3 | 0003 | | | TR | SEPACTV |
| 4648 | 3D72 | 4672 | | | BZ | ACRL10 |
| | | | | 5. . . . . THEN | | |
| | | | | 6. . . . . RESET SEPACTV | | |
| 464A | A147 | 0047 | | | STB | PSB07 |
| | | | | 6. . . . . SET ENABLED | | |
| | | | | | TSB | PSB42,ENABLED |
| 464C | AF80 | 006A | | | | |
| 464E | AF80 | 0007 | | | | |
| 4650 | A16A | 006A | | | | |
| | | | | 6. . . . . RESET TRLSEP | | |
| | | | | | TRB | PSB43,TRLSEP |
| 4652 | A66B | 006B | | | | |
| 4654 | B7 | 0007 | | | | |
| 4655 | A16B | 006B | | | | |
| | | | | 6. . . . . IF TRLSEP WAS 1 &ACR1 WENT TO 0 | | |
| 4657 | 3D6E | A66E | | | BZ | ACRL11W |
| | | | | | TPB | PSB43,ACRBILL2 |
| 4659 | A66B | 006B | | | | |
| 465B | 94 | 0004 | | | | |
| 465C | 25 | | | | | |
| 465D | 4E | 466E | | | JZ | ACRL11W |
| 465E | A40E | 000E | | | AB | ACRRELGLO |
| 4660 | 6E | 466E | | | JNZ | ACRL11W |
| | | | | 6. . . . . THEN | | |
| | | | | 7. . . . . CPYSLCT = SEPSLCT | | |
| | | | | | SRG | BASERG |
| 4661 | A9C9 | 00C9 | | | | |
| 4663 | E9 | 0009 | | | LR | SEPSLCT |
| | | | | | SRG | INTHRG |
| 4664 | A9C8 | 00C8 | | | | |
| 4666 | 89 | 0009 | | | STR | CPYSLCT |
| | | | | 7. . . . . SEPSLCT, PRVSLCT = 0 | | |
| 4667 | 25 | | | | CLA | |
| | | | | | SRG | BASERG |
| 4668 | A9C9 | 00C9 | | | | |
| 466A | 89 | 0009 | | | STR | SEPSLCT |
| | | | | | SRG | COLRG |
| 466B | A9D0 | 00D0 | | | | |
| 466D | 8A | 00CA | | | STR | PRVSLCT |
| | | | | 6. . . . . ENDIF | | |
| | | | | ACRL11W | SRG | INTHRG |
| 466E | A9C8 | 00C8 | | | | |
| 4670 | 2C7F | 467F | | | B | ACRL11 |
| | | | | 5. . . . . ELSE | | |
| | | | | 6. . . . . IF COPIES_IN_DUPLEX_LIGHT | | |
| | | | | | TPB | PCB13,CPYINDFI |
| 6472 | A67D | 007D | | | | |
| 4674 | 93 | 0003 | | | | |
| 4675 | 4F | 467F | | | JZ | ACRL12 |
| | | | | 6. . . . . THEN | | |
| | | | | 7. . . . . SET SIDE-2 | | |
| | | | | | TSB | PSB20,DPXSIDE2 |
| 4676 | A654 | 0054 | | | | |
| 4678 | AF20 | 0005 | | | | |
| 467A | A154 | 0054 | | | | |
| | | | | 7. . . . . ACRLOST=0 | | |
| 467C | 25 | | | | CLA | |
| 467D | A15B | 005B | | | STB | ACRLOST |
| | | | | 6. . . . . ENDIF | | |
| | | | | ACRL12 | EQU | * |
| | | | | 5. . . . . ENDIT | | |
| | | | | 4. . . . ENDIF | | |

TABLE XV-continued

ACRDEC

| LOC | OBJ | OP1 | OP2 | SOURCE STATEMENT | | |
|---|---|---|---|---|---|---|
| | | | | ACRL11 | EQU | * |
| | | | | 3. . . ENDIF | | |
| | | | | ACRL07 | EQU | * |
| | | | | 2. . ENDIF | | |
| | | | | NONPERTINENT CODE | | |
| | | | | 2. . IF ACR1 WENT TO 0 | | |
| 46A5 | 25 | | | | CLA | |
| 46A6 | A40E | 000E | | | AB | ACRREGLO |
| 46A8 | 3CFE | 46FE | | | BNZ | ACRL14 |
| | | | | 2. . THEN | | |
| | | | | 2. . . TURN TRUCKS OFF | | |
| | | | | | TRMB | PCB02,P(PRMTRCK,ALTTRUCK,DPLXTRCK) |
| 46AA | A673 | 0073 | | | | |
| 46AC | ABE3 | 00E3 | | | | |
| 46AE | A173 | 0073 | | | | |
| 46B0 | A670 | 0070 | | | | |
| 46B2 | ABF8 | 00F8 | | | | |
| 46B4 | A170 | 0070 | | | | |
| | | | | NONPERTINENT CODE | | |
| | | | | 4. . . . IF SEPARIND & ¬SEPWAIT & ¬ACRREQ & DRIVE | | |
| | | | | | TPB | PCB06,SEPARIND |
| 46D6 | A677 | 0077 | | | | |
| 46D8 | 92 | 0002 | | | | |
| 46D9 | 3DEC | 46EC | | | BZ | ACRCD01 |
| 46DB | A641 | 0041 | | | LB | PSB01 |
| 46DD | AB22 | 0022 | | | NI | P1(SEPWAIT,ACRREQ) |
| 46DF | 6C | 46EC | | | JNZ | ACRCD01 |
| | | | | | TPB | PSB21,DRIVE |
| 46E0 | A655 | 0055 | | | | |
| 46E2 | 90 | 0000 | | | | |
| 46E3 | 4C | 46EC | | | JZ | ACRCD01 |
| | | | | 4. . . . THEN | | |
| | | | | 5. . . . . SET STARTSE | | |
| | | | | | TSB | PSB07,STARTSE |
| 46E4 | A647 | 0047 | | | | |
| 46E6 | AF80 | 0007 | | | | |
| 46E8 | A147 | 0047 | | | | |
| 46EA | 2CFE | 46FE | | | B | ACRCD02 |
| | | | | 4. . . . ELSE | | |
| | | | | NONPERTINENT CODE | | |
| | | | | 5. . . . . ENDIF | | |
| | | 46FE | | ACRCD02 | DC | * |
| | | | | 4. . . . ENDIF | | |
| | | | | ACRL15 | EQU | * |
| | | | | 3. . . ENDIF | | |
| | | | | ACRIL14 | EQU | * |
| | | | | 2. . ENDIF | | |
| | | | | 1. ENDIF | | |
| | | | | NONPERTINENT CODE | | |

Figure 21:
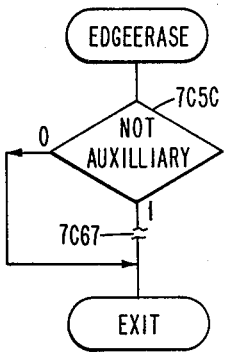
FIG. 21 is a flowchart showing the pertinent parts of the EDGEERASE process.

Finally, in FIGS. 20 and 21 the billing and edge erase programs are shown as they relate to the separation mode. Only one instruction in each of the programs is pertinent, viz., in FIG. 20, the step 5DDD and, in FIG. 21, the step 7C5C are pertinent. Both are identical in that the processor branches on whether an auxiliary operation is being performed. These two steps are identical to the step 77EC in FIG. 16 as detailed in source code in Table XII.

In summary, the copy production machine 10 can either be hardware or software controlled for performing the separation mode which effects a logical extension of the capability of collators in that plural sets of copies can be inserted into given collator bins with a separator sheet and with a minimal operator inconvenience. The automatic controls described above can take any of a plurality of forms including programmable logic arrays, read-only memories, hard logic as indicated in the first part of the application, or a programmed computer as set forth in the preferred embodiment. The form of technology involved in implementing the present invention is not pertinent to the practice of the invention, the important features being the machine functions performed in implementing the separation mode.

Inhibiting billing for separation sheets is intended to include separately counting separation sheets. Then, the separate separation count can be used for a reduced billing rate (regular copy billing rate inhibited) or as a basis for relating copy billing. In the broad method aspects, the billing meter could, in fact, be actuated and the separate separation count used to adjust the total bill.

While the invention has been particularly shown and described with reference to a preferred embodiment thereof, it will be understood by those skilled in the art that various changes in form and details may be made therein without departing from the spirit and scope of the invention.

What is claimed is:

1. In a copy production machine having operating means comprising image input means, copy production means, copy output means having a given capacity, and copy sheet transport path means extending between said copy production means and said copy output means for transporting copy sheets therebetween, copy sheet source means for supplying copy sheets to said copy production means to receive images, the improvement comprising, in combination:

programmable processor means for executing computer programs and having input register means for receiving signals to be operated upon in accordance with computer programs and output register means for supplying control signals to said machine generated in accordance with execution of computer programs;

means included in said operating means coupled to said input register means for supplying status signals to said processor;

actuating means in said operating means coupled to said output register means for receiving control signals to control operation of said operating means;

console means including a plurality of switch means coupled to said input register means for providing operating parameters to control said processor means in operating said machine and a plurality of indicator means coupled to said output register means for displaying the status of said machine;

control memory means included in said processor means for storing a plurality of computer program means sensible and executable by said processor to enable said processor means to supply said control signals in response to said status signals and said parameter signals to operate said machine to produce a console-selected number of copies of each image supplied by said image input means to said copy producing means in succession of copy production runs, said program means including means for responding to one of said plurality of switch means indicating, when actuated, that copy sheets are to be supplied from said copy sheet source means and including inhibiting means for preventing the copying of images onto said supplied copy sheets whereby said supplied copy sheets become separator sheets, means for limiting a production run to said output means given capacity if the operating parameter representing a number of copies to be produced supplied by said switch means exceeds said given capacity, and means for indicating cumulative copies produced in a series of copy production runs in response to said one of said plurality of switch means being actuated.

2. The invention as claimed in claim 1 wherein said program means includes:

means for responding to status signals from said copy production means indicating storage of partially-produced copies therein; and means for transporting said partially-produced copies as completed copies to said output means and then transport said separator sheets in response to said status signals indicating stored copies and said one of said panel switches being actuated.

3. The invention as claimed in claim 1 wherein said image input means includes original document feed means having an entry station means, and sensing switch means in said entry station means for supplying a status signal indicating that an image is to be transferred, and wherein said program means includes:

means for responding to a status signal from said image input means indicating that an image is to be transferred to one or more copy sheets for delaying transport of said separator sheets until copies have been produced of said image to be transferred.

4. The invention as claimed in claim 1 wherein said program means includes means for receiving from said console means signal representative of the numbers of copies to be produced;

means responsive to another one of said switch means, when actuated, for producing duplex copies including means for storing copy sheets bearing one-sided copies, and means for feeding said stored copy sheets to said copy production means to receive second side images; and means responsive to said one of said plurality of switch means to said other one of said switch means and to signals indicating that single-sided copies are stored for delaying feeding of copy sheets as separator sheets until said second side copies have been produced.

* * * * *